US007866165B2

(12) United States Patent
Jang et al.

(10) Patent No.: US 7,866,165 B2
(45) Date of Patent: Jan. 11, 2011

(54) REFRIGERATOR WITH A DISPENSER

(75) Inventors: Heon-jae Jang, Changwon-shi (KR); Seung-beom Chae, Gangneung-shi (KR); Il-wook Joung, Gimhae-shi (KR); Sang-ho Park, Gimhae-shi (KR); Yong-chul Kwon, Changwon-shi (KR); Hyeon-jin Kim, Masan-shi (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 12/000,323

(22) Filed: Dec. 11, 2007

(65) Prior Publication Data

US 2008/0173037 A1 Jul. 24, 2008

(30) Foreign Application Priority Data

Dec. 11, 2006 (WO) ..... PCT/KR2006/005389

(51) Int. Cl.
*B67D 5/62* (2006.01)

(52) U.S. Cl. ..... 62/66; 62/344; 62/389; 222/146.6

(58) Field of Classification Search ..... 62/66–74, 62/340–356, 389–400; 222/146.6
See application file for complete search history.

(56) References Cited

U.S. PATENT DOCUMENTS 4,543,800 A 10/1985 Mawby et al.
4,800,935 A 1/1989 Buchser et al.
4,807,086 A 2/1989 Chambliss
5,033,273 A * 7/1991 Buchser et al. ..... 62/344
5,405,052 A 4/1995 Sawyer, III
5,766,453 A 6/1998 Morellato et al.
6,135,173 A * 10/2000 Lee et al. ..... 141/361
6,651,449 B2 * 11/2003 Heims et al. ..... 62/98

(Continued)

FOREIGN PATENT DOCUMENTS

CN 1659413 A 8/2005

(Continued)

OTHER PUBLICATIONS

Chinese Office Action issued in Chinese Patent Application No. 200680056414X, mailed Feb. 5, 2010, 8 pages.

(Continued)

*Primary Examiner*—William E Tapolcai
(74) *Attorney, Agent, or Firm*—Fish & Richardson P.C.

(57) ABSTRACT

A refrigerator dispenser includes an ice dispensing actuator, an ice dispensing chute oriented closer to a front surface of a refrigerator door than the ice dispensing actuator, a liquid dispensing actuator oriented closer to the front surface of the refrigerator door than the ice dispensing actuator and the ice dispensing chute, and a liquid dispensing chute oriented closer to the front surface of the refrigerator door than the ice dispensing actuator, the ice dispensing chute, and the liquid dispensing actuator.

The ice dispensing actuator, the ice dispensing chute, the liquid dispensing actuator, and the liquid dispensing chute are arranged in a serial order, along a vertical plane that extends substantially perpendicular to the front surface of the refrigerator door within which the cavity exists, from a relatively deep position within the cavity to a relatively shallow position within the cavity or the front of the cavity.

20 Claims, 19 Drawing Sheets

U.S. PATENT DOCUMENTS

| | | | | |
|---|---|---|---|---|
| 6,679,082 | B1 | 1/2004 | Tunzi | |
| 7,201,005 | B2 * | 4/2007 | Voglewede et al. | 62/126 |
| 7,455,085 | B2 | 11/2008 | Voglewede et al. | |
| 2003/0019236 | A1 | 1/2003 | Heims | |
| 2004/0183414 | A1 | 9/2004 | Kwon | |
| 2004/0187516 | A1 | 9/2004 | Lee | |
| 2005/0072178 | A1 | 4/2005 | Park et al. | |
| 2006/0065008 | A1 | 3/2006 | Park | |
| 2006/0196214 | A1 | 9/2006 | Lee et al. | |
| 2006/0201190 | A1 | 9/2006 | Bowen et al. | |
| 2006/0201194 | A1 | 9/2006 | Bowen et al. | |

FOREIGN PATENT DOCUMENTS

| | | | |
|---|---|---|---|
| CN | 1683874 | A | 10/2005 |
| CN | 1707205 | A | 12/2005 |
| EP | 1 605 219 | | 12/2005 |
| KR | 10-2004-0013820 | | 2/2004 |
| KR | 10-2006-0104357 | | 10/2006 |
| WO | 03/102481 | | 12/2003 |

OTHER PUBLICATIONS

Supplementary Search Report issued in European Application No. EP 06 82 4095, mailed Jan. 12, 2010, 6 pages.

Search Report issued in European Application No. EP 09 01 1469, mailed Jan. 20, 2010, 5 pages.

USPTO Non-Final Office Action issued in U.S. Appl. No. 12/000,321, mailed Dec. 2, 2009, 24 pages.

Korean Office Action issued in Korean Application No. 10-2008-7031189, dated May 18, 2009, 9 pages.

Non-Final Office Action issued in U.S. Appl. No. 12/000,324, mailed Jun. 15, 2010, 17 pages.

Final Office Action issued in U.S. Appl. No. 12/000,321, mailed Jun. 30, 2010, 28 pages.

Chinese Office Action issued in Application No. 200910171363.0, dated Sep. 14, 2010, 13 pages.

Chinese Office Action dated Oct. 18, 2010 for Chinese Patent Application No. 200910171361.1, in English language, 8 pages.

* cited by examiner

REFRIGERATOR WITH A DISPENSER

TECHNICAL FIELD

This disclosure relates to a refrigerator including a dispenser.

DESCRIPTION OF RELATED ART

FIG. 1 illustrates an example of a refrigerator including a dispenser. In this example, the refrigerator 100 includes a dispenser 120 positioned on a freezing chamber door 110. The dispenser 120 has an outlet region 130 that includes operation levers 140 and a support 150.

FIG. 2 illustrates an example of a refrigerator including a dispenser. In this example, the refrigerator 200 includes a dispenser 220 positioned on a refrigerating chamber door 210.

FIG. 3 illustrates another example of a refrigerator including a dispenser. In this example, the refrigerator 300 includes a freezing chamber 310 and a refrigerating chamber 320. An ice maker 330 is installed in the freezing chamber 310 and a dispenser 350 is installed on a freezing chamber door 340. A flow path 360 is connected to an external water supply source (not shown) and configured to supply water to the ice maker 330 and the dispenser 350. A first valve 370, a filter 380, and a second valve 390 may be provided at various points along the flow path 360. The first valve 370 may be configured to control water supply from the external water supply source to the refrigerator 300, the filter 380 may be configured to filter water, and the second valve 390 may be configured to control water supply to the ice maker 330 and the dispenser 350. The first valve 370 and the second valve 390 may be controlled by a control unit (not shown) of the refrigerator 300. The flow path 360 includes a flow path 361 configured to supply water to the dispenser 350. Water flowing through the flow path 361 may be cooled by heat exchange with the freezing chamber 310 and discharged through an outlet 362 of the flow path 361 to an outlet region 351 of the dispenser 350.

FIG. 4 illustrates another example of a refrigerator including a dispenser. In this example, the refrigerator 400 includes an operation panel 410 and an ice maker 420. The operation panel 410 includes a display 411 and at least one button 412. The ice maker 420 may be connected to an outlet region 451 through a passage 421. When a user selects cold water by activating the button 412 and pressing an operation lever 452, water is discharged through an outlet 462. When the user selects cubed ice or crushed ice by activating the button 412 and pressing the operation lever 452, cubed ice or crushed ice is discharged through an outlet 422.

FIG. 5 illustrates a refrigerator including a dispenser. The refrigerator 500 includes a pad type button 510 instead of an operation lever. The user selects cold water or ice by using the operation panel 520, and presses the button 510 with a cup (not shown) to obtain cold water or ice.

FIGS. 6 and 7 illustrate an example of a dispenser structure for a refrigerator. The dispenser structure includes an ice bank 610 connected to the dispenser structure configured to store ice. The ice bank 610 includes transfer screws 611 and 612 configured to transfer ice, and cutters 613 and 614 positioned at a front portion of the transfer screws 611 and 612 and configured to cut ice into different sizes. The cut ice may be discharged to an outlet region 630 through a passage 620.

FIGS. 8 and 9 illustrate an example of a dispenser for a refrigerator. The dispenser includes an outlet region 830 and a cold water supply unit 820 that has a cold water outlet 810. As shown in FIG. 8, the cold water outlet 810 of the cold water supply unit 820 is positioned in the outlet region 830 in the dispenser 800. As shown in FIG. 9, the cold water outlet 810 of the cold water supply unit 820 has been slidably extended such that the outlet of the cold water outlet 810 is positioned outside of the outlet region 830 in the dispenser 800. In this example, even if a container 840 configured to contain cold water is too big to enter the outlet region 830, cold water may be supplied to the container 840.

SUMMARY

In one aspect, a refrigerator dispenser includes a refrigerator dispensing assembly arranged integral to a refrigerator door and defining a cavity within a front surface of the refrigerator door, an ice dispensing actuator positioned within the cavity defined by the refrigerator dispensing assembly, and an ice dispensing chute positioned within the cavity defined by the refrigerator dispensing assembly and oriented closer to the front surface of the refrigerator door than the ice dispensing actuator. The refrigerator dispenser also includes a liquid dispensing actuator positioned within the cavity defined by the refrigerator dispensing assembly and oriented closer to the front surface of the refrigerator door than the ice dispensing actuator and the ice dispensing chute, and a liquid dispensing chute oriented closer to the front surface of the refrigerator door than the ice dispensing actuator, the ice dispensing chute, and the liquid dispensing actuator. The ice dispensing actuator, the ice dispensing chute, the liquid dispensing actuator, and the liquid dispensing chute are arranged in the following serial order, along a plane that extends substantially perpendicular to the front surface of the refrigerator door within which the cavity is defined, from a relatively deep position within the cavity to a relatively shallow position within the cavity or to the front of the cavity: the ice dispensing actuator, the ice dispensing chute, the liquid dispensing actuator, and the liquid dispensing chute.

Implementations may include one or more of the following features. For example, the liquid dispensing actuator may be configured to accommodate being actuated by a deepest surface of a container inserted a relatively short distance into the cavity and the ice dispensing actuator may be configured to accommodate being actuated by the deepest surface of the container when inserted a further and relatively deep distance into the cavity. The relatively short distance being defined such that, upon actuation of the liquid dispensing actuator by the deepest surface of the container, the container is not positioned under the ice dispensing chute.

In some implementations, the plane that extends substantially perpendicular to the front surface of the refrigerator door may be a vertical plane. The liquid dispensing chute may be positioned outside of the cavity defined by the refrigerator dispensing assembly. The liquid dispensing chute may be positioned within the cavity defined by the refrigerator dispensing assembly, and the refrigerator dispenser may include a liquid dispensing assembly to which the liquid dispensing chute is attached. The liquid dispensing assembly may be configured to extend along a plane perpendicular to the front surface of the refrigerator door from a withdrawn position to an extended position to move the liquid dispensing chute outside of the refrigerator door cavity.

In some examples, the liquid dispensing actuator positioned in the ice dispensing cavity may be a first liquid dispensing actuator, and the refrigerator dispenser may include a second liquid dispensing actuator positioned on the liquid dispensing assembly. The second liquid dispensing actuator may be configured to inspire dispensing of liquid through the liquid dispensing chute when the liquid dispensing assembly is in the extended position. The second liquid dispensing actuator may be configured to inspire dispensing of liquid through the liquid dispensing chute only when the liquid dispensing assembly is in the extended position and the first liquid dispensing actuator is configured to inspire dispensing of liquid through the liquid dispensing chute only when the liquid dispensing assembly is in the withdrawn position. The second liquid dispensing actuator may be positioned on a top surface of the liquid dispensing assembly and hidden when the liquid dispensing assembly is in the withdrawn position.

The liquid dispensing actuator may be positioned higher than the ice dispensing actuator. The liquid dispensing actuator may be configured to accommodate being actuated by a deepest surface of a container such that a container whose deepest surface actuates the liquid dispensing actuator is not positioned below the ice dispensing chute and thus is not exposed to ice dispensed through the ice dispensing chute.

The liquid dispensing actuator may be configured to accommodate being actuated by the deepest surface of the container such that an opening of the container is positioned in front of an outlet of the ice dispensing chute. The liquid dispensing actuator may be configured to accommodate being actuated by the deepest surface of the container such that an opening of the container is positioned above an outlet of the ice dispensing chute. The refrigerator door may be a door of a refrigerating compartment of a refrigerator or may be a door of a freezing compartment of a refrigerator.

In another aspect, a refrigerator includes a refrigerator door, and a dispenser arranged integral to the refrigerator door. The dispenser includes a housing defining a cavity within a front surface of the refrigerator door, an ice dispensing actuator positioned within the cavity defined by the housing, and an ice dispensing chute positioned within the cavity defined by the housing and oriented closer to the front surface of the refrigerator door than the ice dispensing actuator. The dispenser also includes a liquid dispensing actuator positioned within the cavity defined by the housing and oriented closer to the front surface of the refrigerator door than the ice dispensing actuator and the ice dispensing chute, and a liquid dispensing chute oriented closer to the front surface of the refrigerator door than the ice dispensing actuator, the ice dispensing chute, and the liquid dispensing actuator. The ice dispensing actuator, the ice dispensing chute, the liquid dispensing actuator, and the liquid dispensing chute are arranged in the following serial order, along a plane that extends substantially perpendicular to the front surface of the refrigerator door within which the cavity is defined, from a relatively deep position within the cavity to a relatively shallow position within the cavity or to the front of the cavity: the ice dispensing actuator, the ice dispensing chute, the liquid dispensing actuator, and the liquid dispensing chute.

In yet another aspect, ice and liquid are dispensed using a dispenser. Actuation of an ice dispensing actuator positioned on a back surface of a dispenser housing that defines a dispensing cavity is received. The ice dispensing actuator is actuated by a deepest surface of a container such that, upon actuation, the container is positioned under an ice dispensing chute. Ice is dispensed into the container through the ice dispensing chute in response to receiving actuation of the ice dispensing actuator. Actuation of a liquid dispensing actuator positioned within the cavity defined by the dispenser housing and oriented closer to a front surface of a refrigerator door than the ice dispensing actuator and the ice dispensing chute is received. The liquid dispensing actuator is actuated by the deepest surface of the container such that, upon actuation, the container is positioned under a liquid dispensing chute and not positioned under the ice dispensing chute. Liquid is dispensed into the container through the liquid dispensing chute in response to receiving actuation of the liquid dispensing actuator.

DETAILED DESCRIPTION

Figure 1:
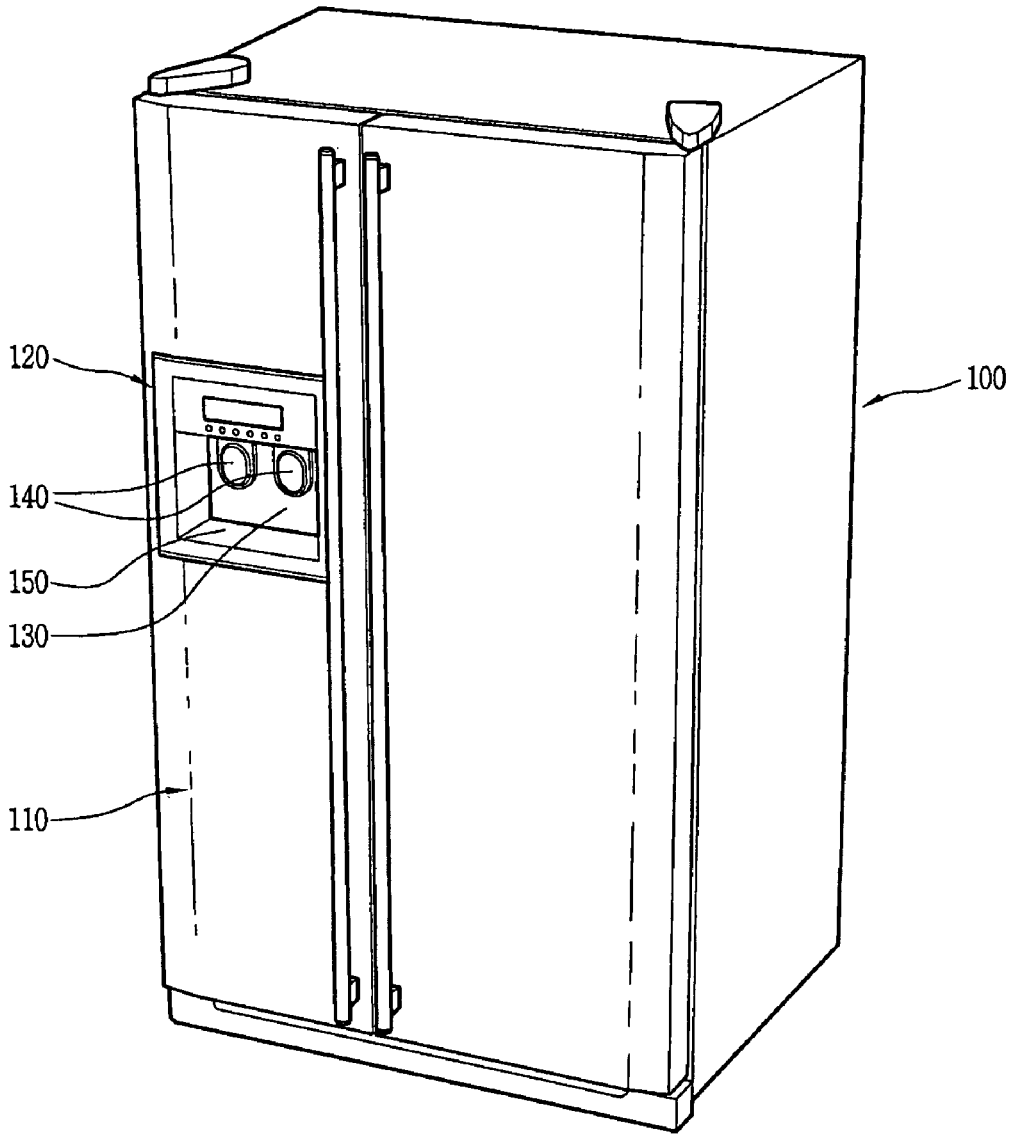
Figure 1 Prior Art
FIGS. 1-5 illustrate examples of a refrigerator that includes a dispenser.
Figure 2:
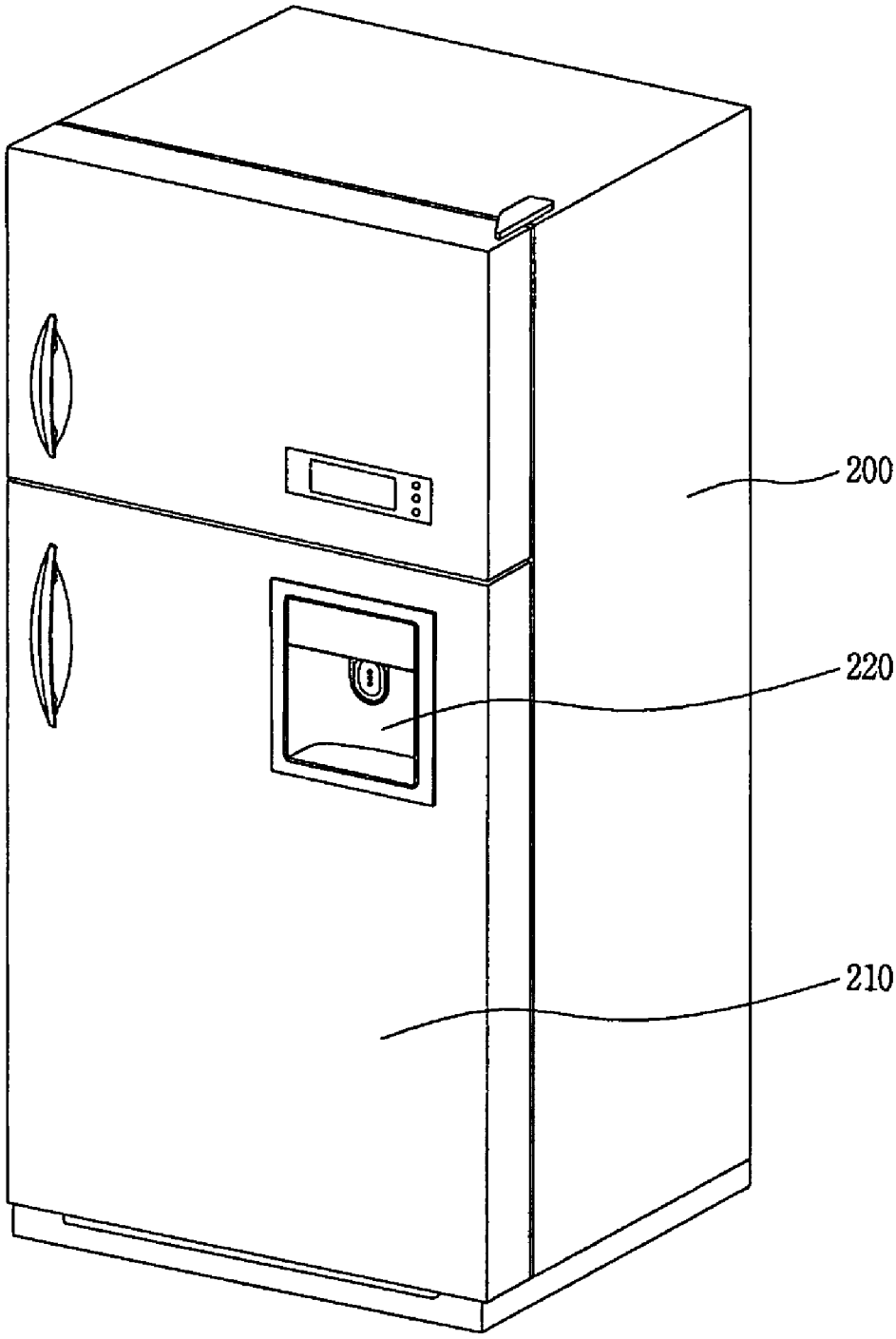
Figure 2 Prior Art
Figure 3:
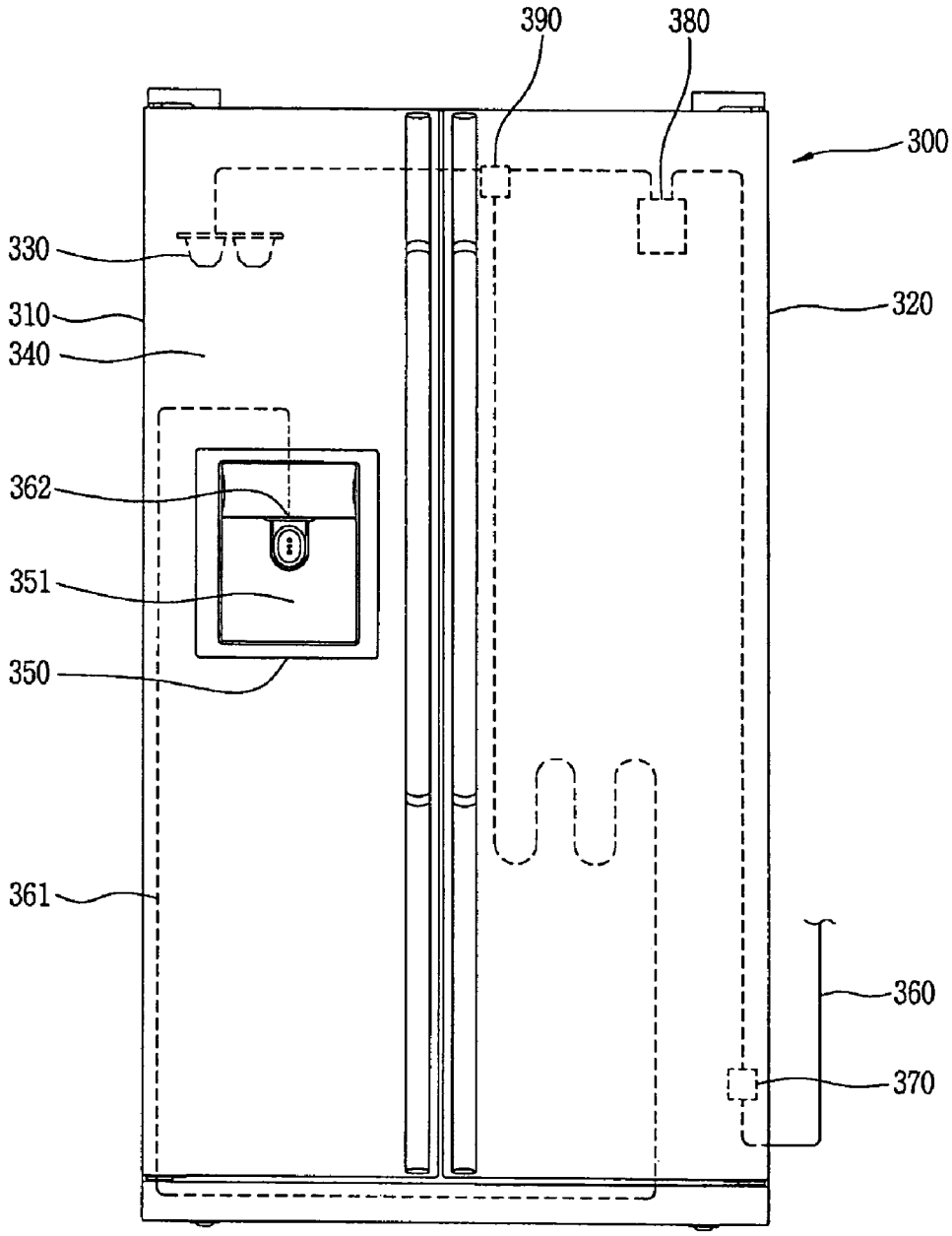
Figure 3 Prior Art
Figure 4:
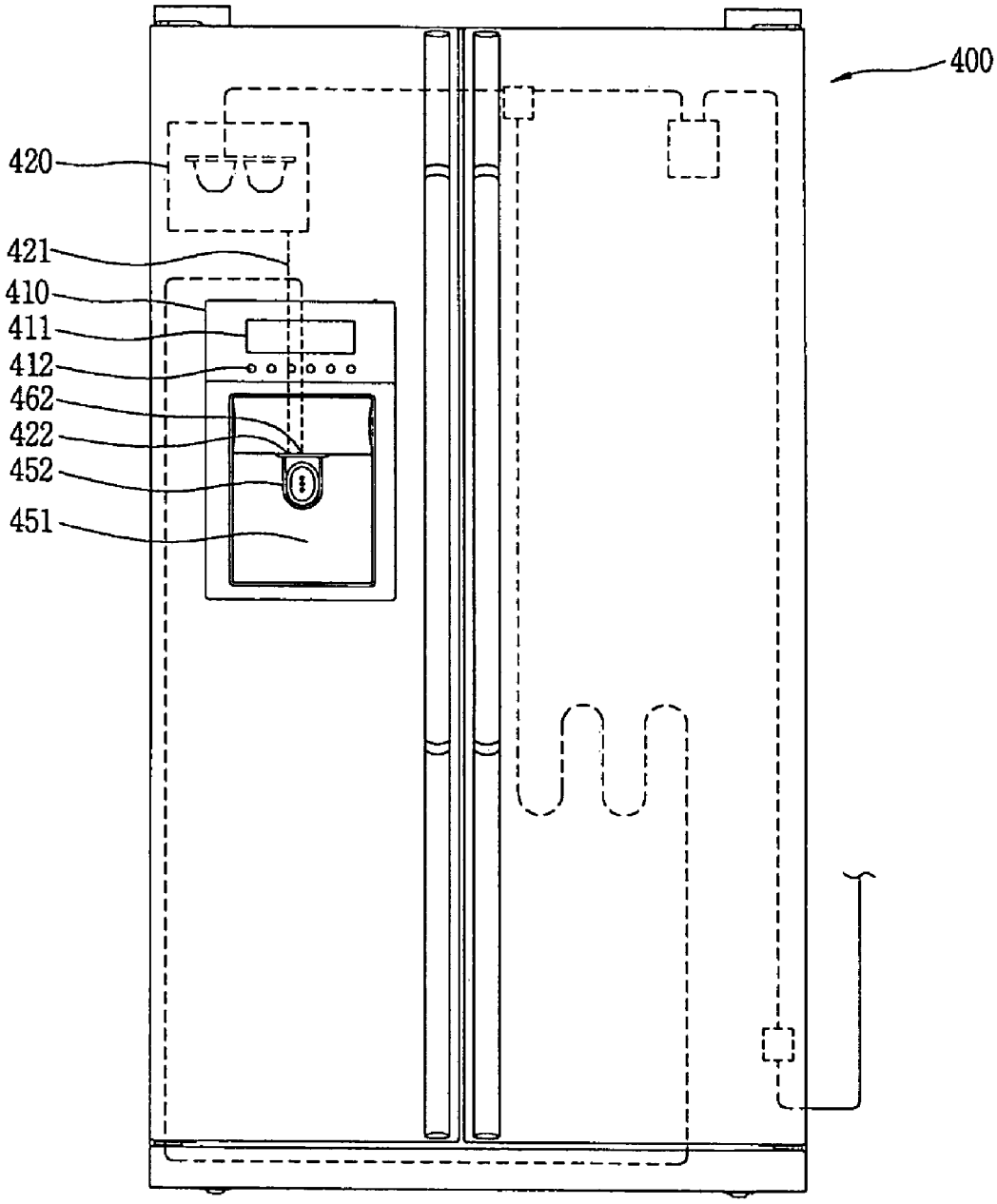
Figure 4 Prior Art
Figure 5:
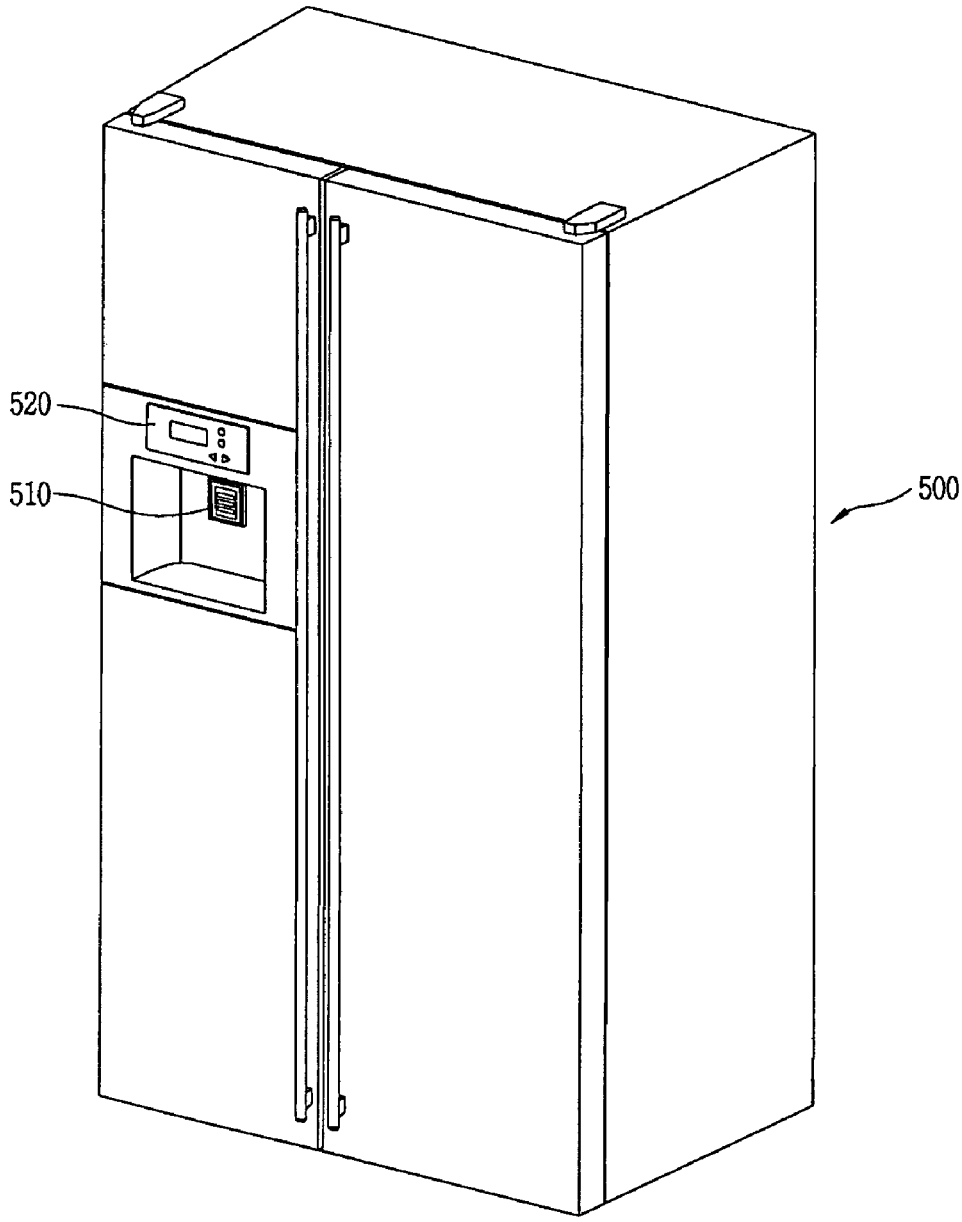
Figure 5 Prior Art
Figure 6:
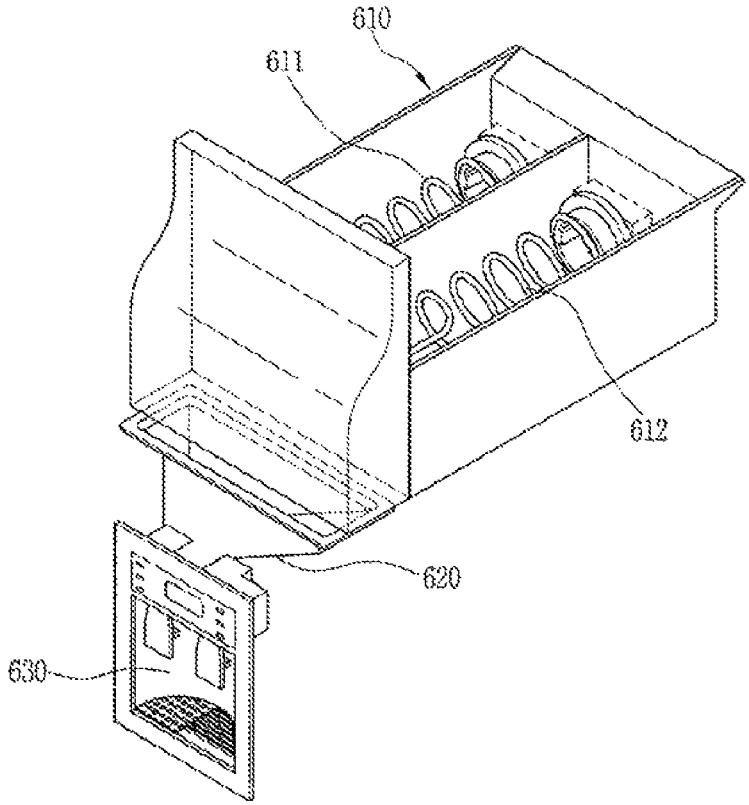
Figure 6 Prior Art
FIGS. 6 and 7 are views illustrating an example of a dispenser structure for a refrigerator.
Figure 7:
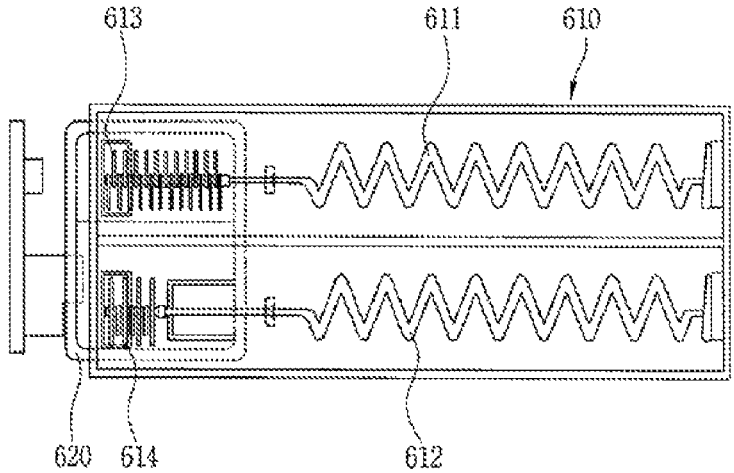
Figure 7 Prior Art
Figure 8:
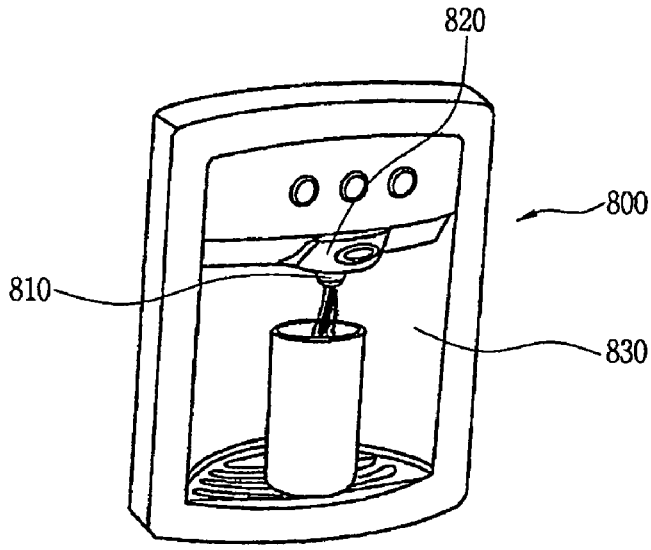
Figure 8 Prior Art
FIGS. 8 and 9 are perspective views illustrating an example of a dispenser for a refrigerator.
Figure 9:
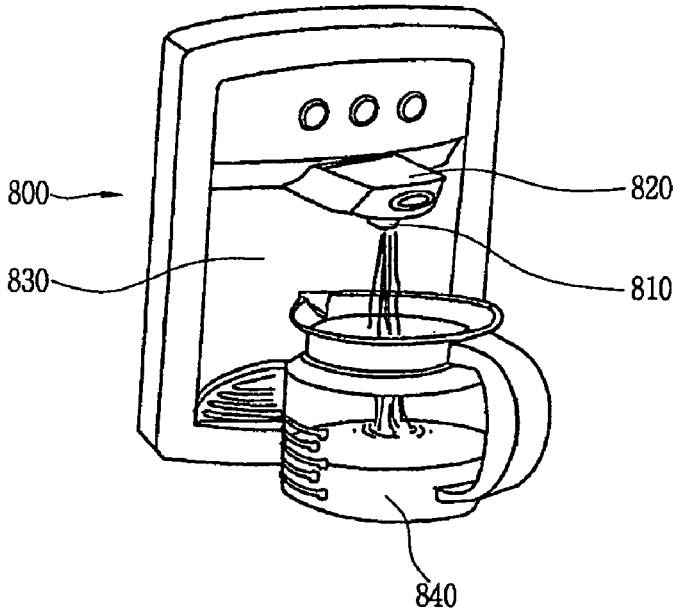
Figure 9 Prior Art
Figure 10:
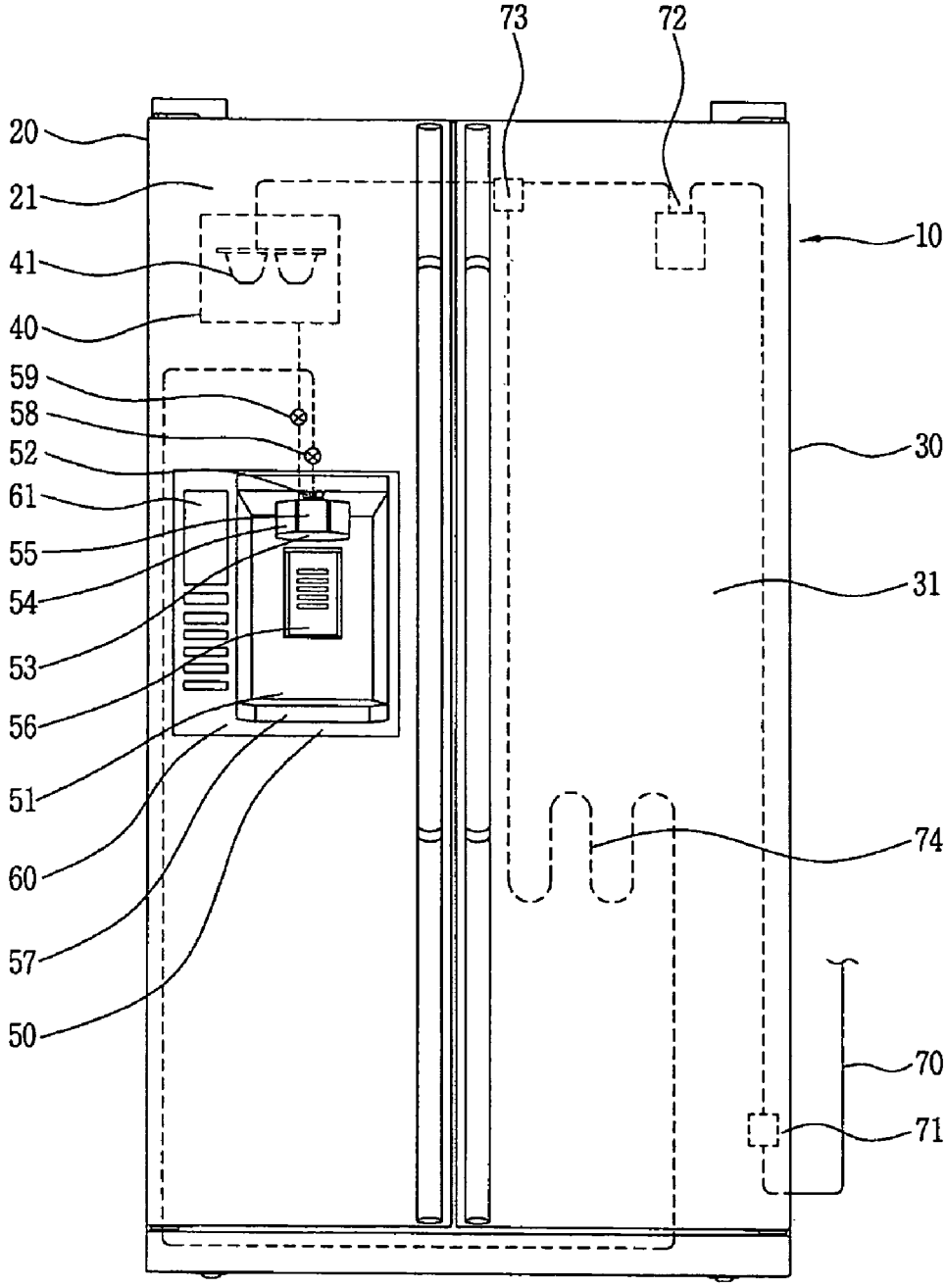
FIG. 10 is a front view illustrating an example of a refrigerator that includes a dispenser.

FIG. 10 is a front view illustrating an example of a refrigerator that includes a dispenser. The refrigerator 10 includes a freezing chamber 20, a freezing chamber door 21 configured to open and close the freezing chamber 20, a refrigerating chamber 30, and a refrigerating chamber door 31 configured to open and close the refrigerating chamber 30. An ice maker 40 is installed in the freezing chamber 20 and configured to make ice. A dispenser 50 is installed on the freezing chamber door 21 and an operation panel 60 configured to control operation of the refrigerator 10 is installed on the freezing chamber door 21 at one side of the dispenser 50.

The refrigerator 10 includes a flow path 70 configured to supply water from an external water supply source (not shown) to the refrigerator 10. A first valve 71, a filter 72, a second valve 73, and a heat exchange unit 74 are provided along on the flow path 70. The first valve 71 is configured to control water supply to the refrigerator 10, the filter 72 filters water, and the second valve 73 controls water supply to the ice maker 40 and the heat exchange unit 74. The heat exchange unit 74 is configured to cool water and is positioned at the side of the refrigerator corresponding to the refrigerating chamber 30. Ice made by the ice maker 40 and water cooled by the heat exchange unit 74 may be discharged through the dispenser 50. Although described above as being positioned at the side of the refrigerator corresponding to the refrigerating chamber 30, the heat exchange unit 74 may be positioned in any part of the refrigerator 10. In some implementations, the ice maker 40 may include only an ice tray 41. In other implementations, the ice maker 40 may include an ice bank (e.g., an ice storage bin) (not shown), an ice transfer unit (not shown) configured to automatically transfer ice from the bank to the dispenser 50, and a breaking mechanism (e.g., a cutter) (not shown) configured to break, cut, or crush ice produced by the ice maker 40. In implementations in which the ice maker 40 includes only the ice tray 41, the user may have to supply ice to an ice bank (not shown) connected to the dispenser 50 to facilitate dispensing of the ice. In implementations that include a breaking mechanism, crushed ice or cubed ice may be provided to the dispenser 50.

The dispenser 50 includes a dispenser cavity 51 which is a concave space formed in a housing of the dispenser 50. The structure defining the dispenser cavity 51 may extend into (or through) the door of the freezing chamber 21. An outlet 52 configured to discharge liquid water is positioned at a top surface of the structure defining the dispenser cavity 51, an outlet 53 configured to discharge ice is positioned behind the outlet 52, and a housing 54 surrounding the outlet 53 extends into the dispenser cavity 51 from the top surface of the structure defining the dispenser cavity. A button type switch 55 is provided on a surface of the housing 54 and is configured to control dispensing of water through the outlet 52. The button type switch 55 may be attached to the housing 54 using a mechanical fastener or may be an integrally formed portion of the housing 54. A pad type switch 56 for discharging ice is provided on a rear surface of the structure defining the dispenser cavity 51. A support 57 is provided at a bottom surface of the structure defining of the dispenser cavity 51. Valves 58 and 59 are provided on flow paths leading to the outlets 52 and 53, respectively, and are configured to control discharge of water and ice from the outlets 52 and 53. In some implementations, in the length (height) direction of the refrigerator 10, the outlet 52, the switch 55, the outlet 53 and the switch 56 are positioned in descending order with respect to the ice maker 40. In other words, the switch 56 is positioned lower (e.g., a greater distance from the ice maker) than the outlet 53, the switch 55, and the outlet 52, the outlet 53 is positioned lower (e.g., a greater distance from the ice maker) than the switch 55 and the outlet 52, and the switch 55 is positioned lower (e.g., a greater distance from the ice maker) than the outlet 52. By positioning the outlet 53 configured to discharge ice lower than the switch 55 configured to control dispensing of water through the outlet 52, a container may be prevented from receiving ice from the outlet 53 when a deepest surface of the container is being used to actuate the switch 55 to control dispensing of water into the container.

In some implementations, in the depth direction of the refrigerator 10, the outlet 52, the switch 55, the outlet 53 and the switch 56 are positioned in serial order in a direction extending from the front surface of the refrigerator to the back surface of the structure defining the dispenser cavity 51. In other words, the outlet 52 is positioned further from the back surface of the structure defining the dispenser cavity 51 than the switch 55, the outlet 53, and the switch 56, the switch 55 is positioned further from the back surface of the structure defining the dispenser cavity 51 than the outlet 53 and the switch 56, and the outlet 53 is positioned further from the back surface of the structure defining the dispenser cavity 51 than the switch 56. The switch 56 may be positioned on the back surface of the structure defining the dispenser cavity 51. Each of the outlet 52, the switch 55, the outlet 53 and the switch 56 may or may not be positioned within the dispenser cavity 51.

Figure 11:
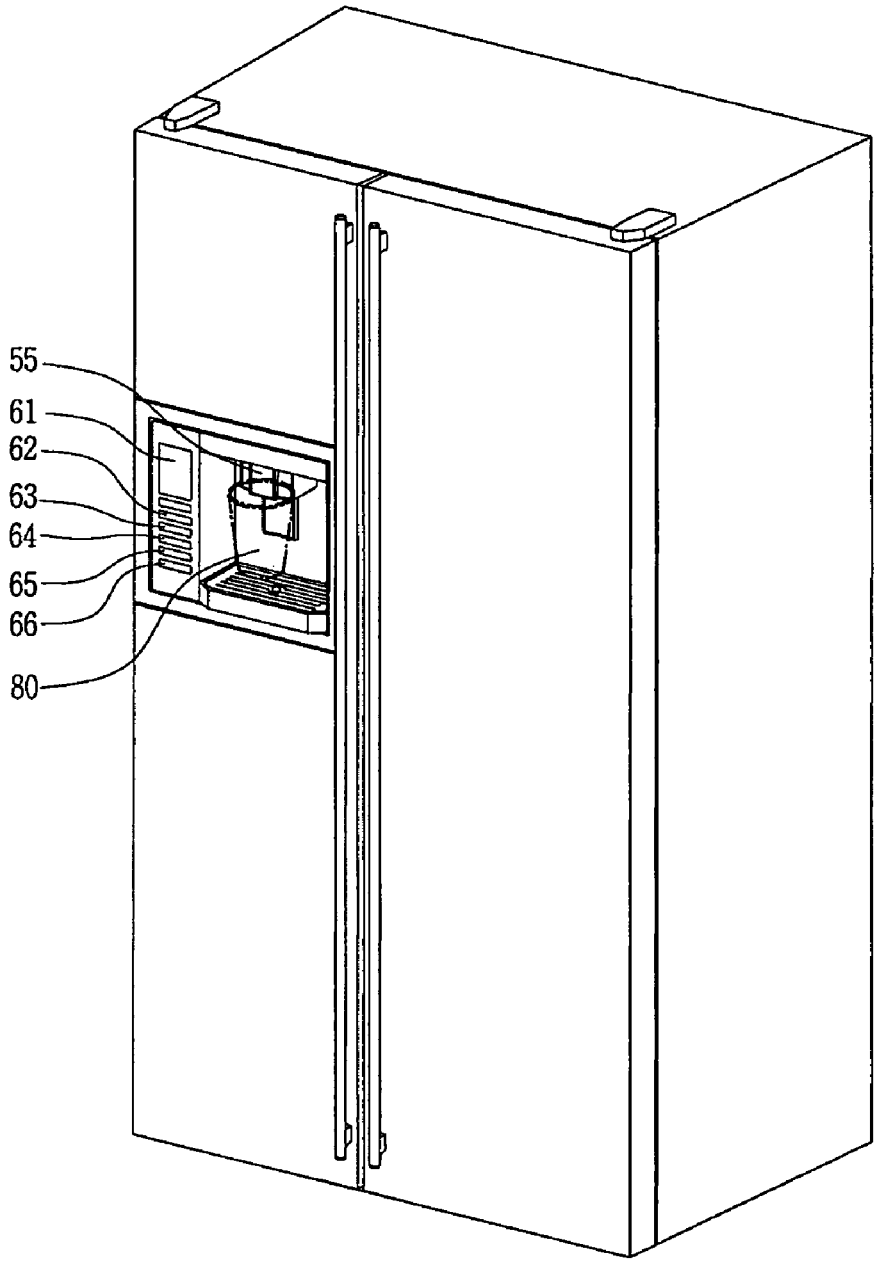
FIGS. 11 and 12 are perspective views illustrating a refrigerator that includes a dispenser.
Figure 12:
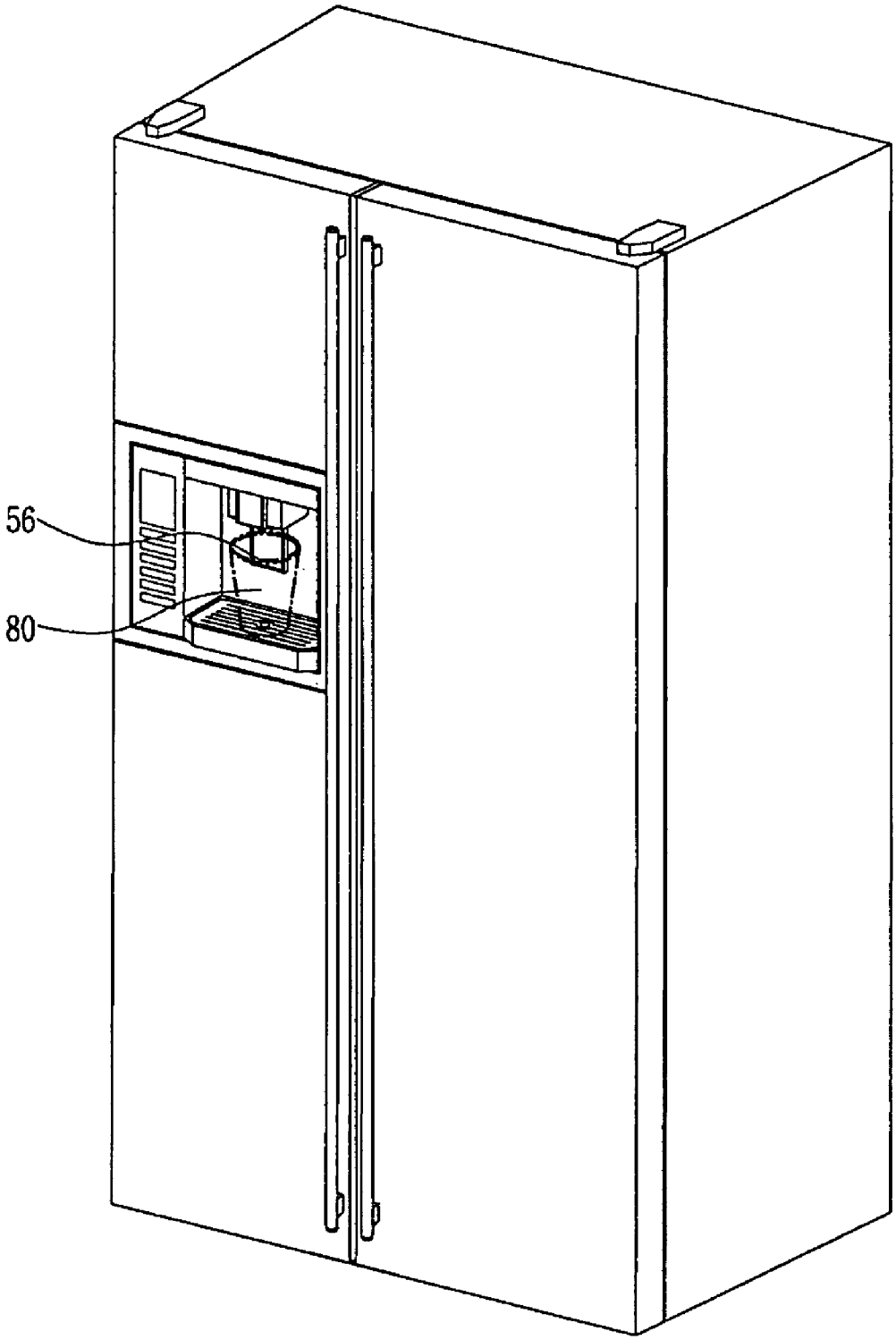

FIGS. 11 and 12 are perspective views illustrating a refrigerator that includes a dispenser. The refrigerator dispenser in the example shown in FIGS. 11 and 12 includes a configuration in which the outlet 52, the switch 55, the outlet 53 and the switch 56 are positioned in serial order in a direction extending from the front surface of the refrigerator to the back surface of the structure defining the dispenser cavity 51. As shown in FIG. 11, a user is able to receive water through the outlet 52 by pressing the switch 55 with a cup 80 (instead of actuating an input control provided on the operation panel 60 and bringing the cup 80 to the switch 56). Accordingly, a user may be able to receive water in a container by inserting the container a relatively shallow distance into the dispenser cavity 51. As shown in FIG. 12, the user may be able to receive ice through the outlet 53 by pressing the switch 56 with the cup 80. Accordingly, a user may be able to receive ice in a container by inserting the container a relatively deep distance into the dispenser cavity 51. In some examples, a container may be sized such that the container may be able to penetrate the dispenser cavity 51 far enough to actuate the switch 55 to receive water into the container, but unable to penetrate the dispenser cavity 51 far enough to actuate the switch 56 to receive ice into the container. The user may be able to receive water by using the switch 55, and then receive ice by using the switch 56. In some implementations, the user is able to receive water, ice, or water and ice without actuating an input control on the operation panel 60. In some examples, the structure prevents a user from receiving ice into a container when the user presses the deepest surface of the container in the cavity against the switch 55 because, in this position, the container is positioned entirely in front of the outlet 53.

In some implementations, the outlet 52 may extend into the dispenser cavity 51 instead of being positioned at (or above) the top surface of the structure defining the dispenser cavity 51. In some examples, the outlet 53 may be configured to discharge water in addition to ice. Each of the switches 55 and 56 may receive contact from a user by the cup 80 in a mechanical manner, convert the mechanical contact into an electrical signal, and transmit the electrical signal to a control unit (not shown) of the refrigerator 10. The switches 55 and 56 may be any type of switch configured to be actuated by a press or presence of a user or an object. For example, the switches 55 and 56 may be mechanical switches, buttons, or levers. In addition, a connection structure of the ice maker 40, the heat exchange unit 74, and the dispenser 50 may be modified and/or changed such that ice and/or water may be discharged through the outlet 53 and crushed ice may be discharged through the outlet 52.

As shown in the example illustrated in FIG. 11, the operation panel 60 includes a display 61 configured to render a user interface to display the state or status of the refrigerator 10 and various buttons 62 configured to receive user input to control operation of the refrigerator 10. For example, the buttons of the operation panel 60 may include a button 63 configured to enable selection of cubed ice or crushed ice, a button 64 configured to control the dispenser 50 to discharge water through the outlet 52, a button 65 configured to discharge ice through the outlet 53, and a button 66 configured to enable selection of one of water, cubed ice, or crushed ice to be discharged through the outlet 53. One button may be configured to perform the above functions. For example, a single button may be configured to perform a function related to controlling operation of the refrigerator 10 based on information rendered on the display 61. The operation panel 60 may extend along a horizontal dimension of the dispenser 50 and may be positioned above or below the dispenser 50 or the dispenser cavity 51. The operation panel 60 may extend along an entire horizontal dimension of the front surface of the dispenser 50 and only partially along a vertical dimension of the front surface of the dispenser 50. As shown in FIGS. 10-12, the operation panel 60 extends along a vertical dimension of the dispenser 50 and may be positioned at one side of the dispenser 50 adjacent to the dispenser cavity 51. The operational panel 60 may extend along an entire vertical dimension of the front surface of the dispenser 50 and only partially along a horizontal dimension of the front surface of the dispenser 50.

In some implementations, the dispenser 50 may be accommodated in the freezing chamber door 21 by a hole formed in the surface of the freezing chamber door 21. A sizing ratio of the hole formed in the surface of the freezing chamber door 21 may be defined as a height of the hole divided by a width of the hole and a sizing ratio of the dispenser cavity 51 may be defined as a height of an opening of the dispenser cavity 51 divided by a width of the opening of the dispenser cavity 51. In some implementations, the sizing ratio of the hole in the surface of the freezing chamber door 21 may be different than the sizing ratio of the dispenser cavity 51. For example, in implementations in which the operation panel 60 extends along a horizontal dimension of the dispenser 50, the sizing ratio of the door surface hole may be greater than the sizing ratio of the dispenser cavity 51. In these implementations, a ratio defined by dividing the height of the dispenser cavity 51 with the height of the door surface hole is less than a ratio defined by dividing the width of the dispenser cavity 51 with the width of the door surface hole. In implementations in which the operation panel 60 extends along a vertical dimension of the dispenser 50, the sizing ratio of the door surface hole may be less than the sizing ratio of the dispenser cavity 51. In these implementations, a ratio defined by dividing the height of the dispenser cavity 51 with the height of the door surface hole is greater than a ratio defined by dividing the width of the dispenser cavity 51 with the width of the door surface hole.

In some implementations, the configuration in which a sizing ratio of the door surface hole is different than a sizing ratio of the dispenser cavity 51 may result in improved features. For example, this configuration may be able to cope with a spatial limit of the freezing chamber door 21 caused by the existence of the ice maker 40, the existence of the two outlets 52 and 53 formed in the length direction, the need for the height expansion of the dispenser cavity 51, the existence of a storing chamber formed at the lower portion of the freezing chamber 20 (e.g., a French door refrigerator including a bottom mount freezer compartment), the expansion necessity of the dispenser cavity 51 by the housing 54 and the switch 55, and/or other arrangements. By providing the operation panel 60 above or adjacent to the dispenser cavity 51, contact of the operational panel 60 by spilled water or ice may be limited.

Figure 13:
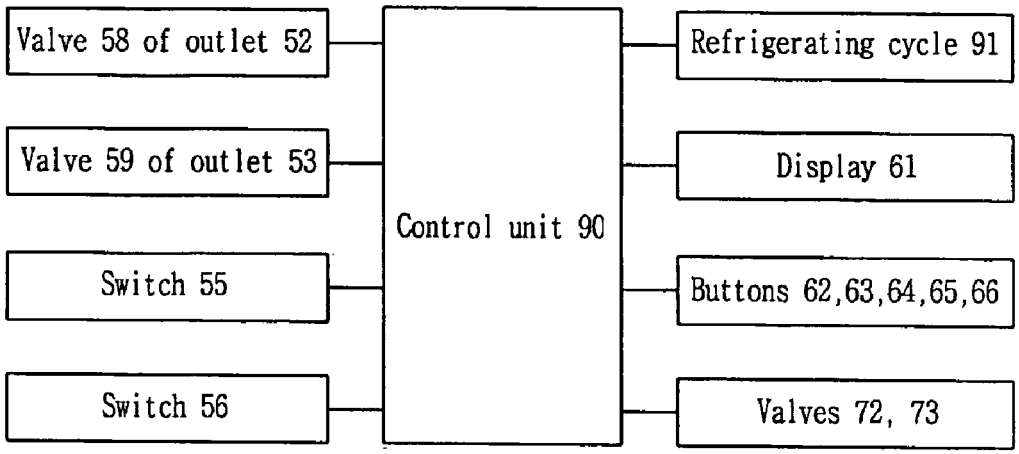
FIG. 13 is a block diagram illustrating an example of a control arrangement configured to operate a refrigerator.

FIG. 13 is a block diagram illustrating an example of a control arrangement configured to operate a refrigerator. A control unit 90 is configured to receive inputs from the buttons 62 to 66, control a refrigerating cycle 91, and control the display 61 to render a display of the operation state of the refrigerator 10. The control unit 90 is configured to control a temperature of water cooled by the heat exchange unit 74 and production of ice by the ice maker 40 by controlling a first valve 71 and a second valve 72. In response to receiving an input from the switch 55, the control unit 90 may be configured to inspire opening of the valve 58 associated with the outlet 52 to supply (e.g., dispense) water through the outlet 52. In response to receiving an input from the switch 56, the control unit 90 may be configured to initiate opening of the valve 59 associated with the outlet 53 to supply (e.g., dispense) ice through the outlet 53.

The control unit 90 may be configured to handle concurrent actuation of the switch 55 and the switch 56. In some implementations, the control unit 90 may be configured to inspire simultaneous dispensing of water and ice in response to concurrent actuation of the switch 55 and the switch 56 (e.g., inspire opening of both the valve 58 and the valve 59). In other implementations, the control unit 90 may be configured to prevent dispensing both water and ice in response to concurrent actuation of the switch 55 and the switch 56. For example, the control unit 90 may be configured to prevent dispensing of water and prevent dispensing of ice in response to concurrent actuation of the switch 55 and the switch 56 (e.g., prevent opening of both the valve 58 and the valve 59). In another example, the control unit 90 may be configured to prevent dispensing of water and allow dispensing of ice in response to concurrent actuation of the switch 55 and the switch 56 (e.g., prevent opening of the valve 58 and inspire opening of the valve 59). In a further example, the control unit 90 may be configured to allow dispensing of water and prevent dispensing of ice in response to concurrent actuation of the switch 55 and the switch 56 (e.g., inspire opening of the valve 58 and prevent opening of the valve 59).

In some implementations, the control unit 90 may be configured to temporarily prevent dispensing both water and ice in response to concurrent actuation of the switch 55 and the switch 56 and allow dispensing in response to a condition being met. For example, the control unit 90 may be configured to prevent dispensing of water and prevent dispensing of ice in response to concurrent actuation of the switch 55 and the switch 56 for a threshold period of time (e.g., prevent opening of both the valve 58 and the valve 59 for the threshold period of time) and to allow simultaneous dispensing of water and ice in response to concurrent actuation of the switch 55 and the switch 56 being maintained for more than the threshold period of time (e.g., inspire opening of both the valve 58 and the valve 59 in response to a user pressing (e.g., pressing and holding) both the switch 55 and the switch 56 for more than the threshold period of time). In another example, the control unit 90 may be configured to allow dispensing of ice and prevent dispensing of water for a threshold period of time in response to concurrent actuation of the switch 55 and the switch 56 (e.g., prevent opening of the valve 58 and inspire opening of the valve 59 for the threshold period of time) and to allow dispensing of water in response to actuation of the switch 55 being maintained for more than the threshold period of time (e.g., inspire opening of the valve 58 in response to a user pressing (e.g., pressing and holding) the switch 55 for more than the threshold period of time). In a further example, the control unit 90 may be configured to allow dispensing of water and prevent dispensing of ice for a threshold period of time in response to concurrent actuation of the switch 55 and the switch 56 (e.g., inspire opening of the valve 58 and prevent opening of the valve 59 for the threshold period of time) and to allow dispensing of ice in response to actuation of the switch 56 being maintained for more than the threshold period of time (e.g., inspire opening of the valve 59 in response to a user pressing (e.g., pressing and holding) the switch 56 for more than the threshold period of time). The control unit 90 may be configured to always prevent dispensing of water for a threshold period of time in response to actuation of the switch 55 regardless of the actuation of the switch 56 (e.g., prevent opening of the valve 58 for the threshold period of time) and to allow dispensing of water in response to actuation of the switch 55 being maintained for more than the threshold period of time (e.g., inspire opening of the valve 58 in response to a user pressing (e.g., pressing and holding) the switch 55 for more than the threshold period of time).

In some implementations, the control unit 90 may be configured to determine which of the switch 55 and the switch 56 was first actuated in response to concurrent actuation of the switch 55 and the switch 56. In these implementations, the control unit 90 may be configured to control dispensing of water and ice based on the determination. For example, the control unit 90 may be configured to prevent dispensing of ice and allow dispensing of water responsive to concurrent actuation of the switch 55 and the switch 56 conditioned on determining that the switch 55 was first actuated. In another example, the control unit 90 may be configured to allow dispensing of ice and prevent dispensing of water responsive to concurrent actuation of the switch 55 and the switch 56 conditioned on determining that the switch 56 was first actuated.

Figure 14:
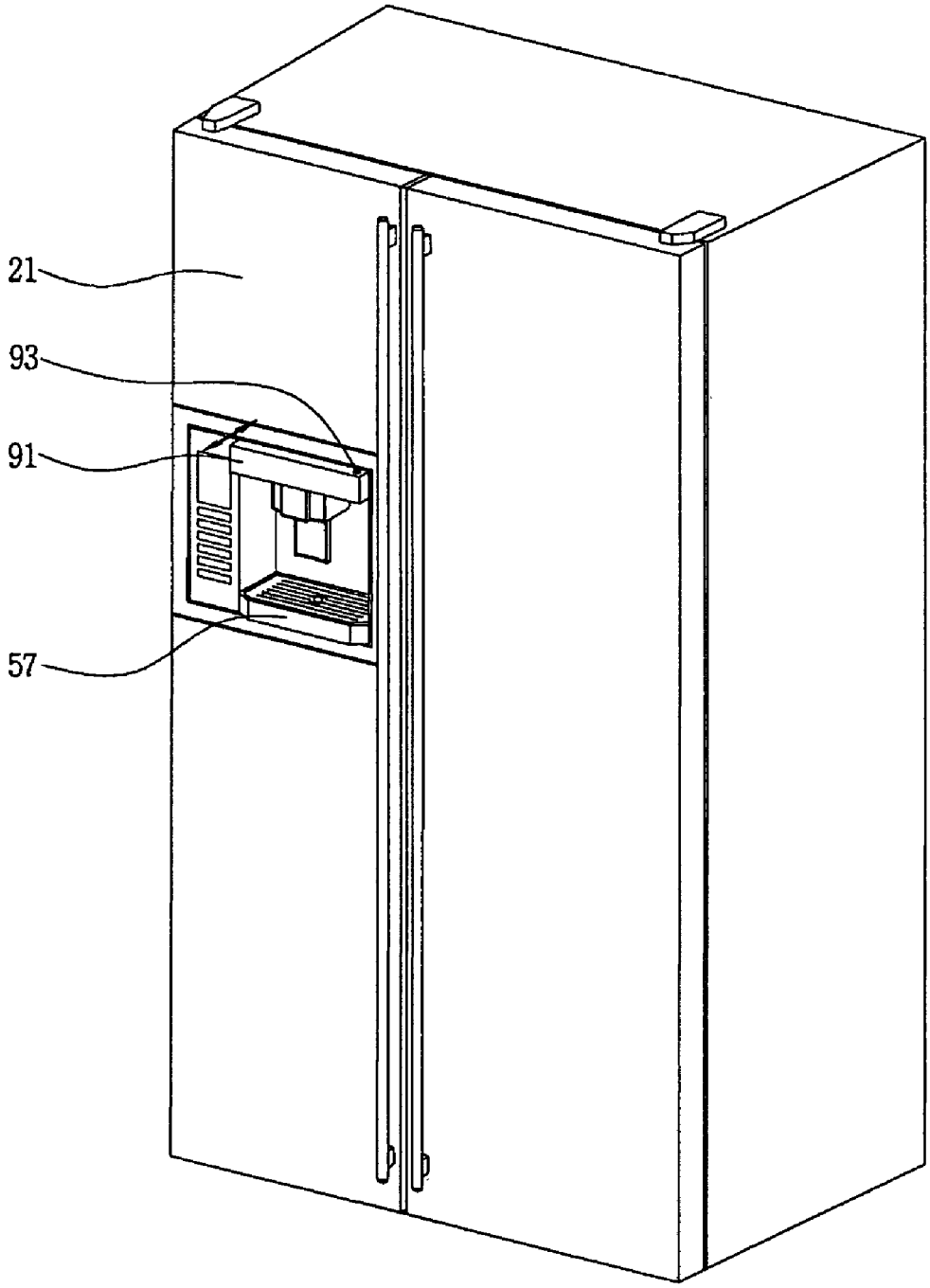
FIG. 14 is a perspective view illustrating an example of a refrigerator that includes a dispenser with a housing including a water supply outlet in an extended position.

In implementations in which the control unit 90 prevents or temporarily prevents simultaneous dispensing of ice and water, problems related to spilling and inadvertent actuation of a dispensing control may be improved. FIG. 14 is a perspective view illustrating an example of a refrigerator that includes a dispenser with a housing including a water supply outlet in an extended position. A housing 91 for the outlet 52 may be slidably formed and configured to extend out from the front of the freezing chamber door 21 from a withdrawn position to an extended position. The outlet may be attached to (e.g., integrally formed with, attached via mechanical fastening or otherwise attached) the housing 91 such that as the housing 91 moves, the outlet 52 also moves to the front of (or outside of) the freezing chamber door 21.

Figure 15:
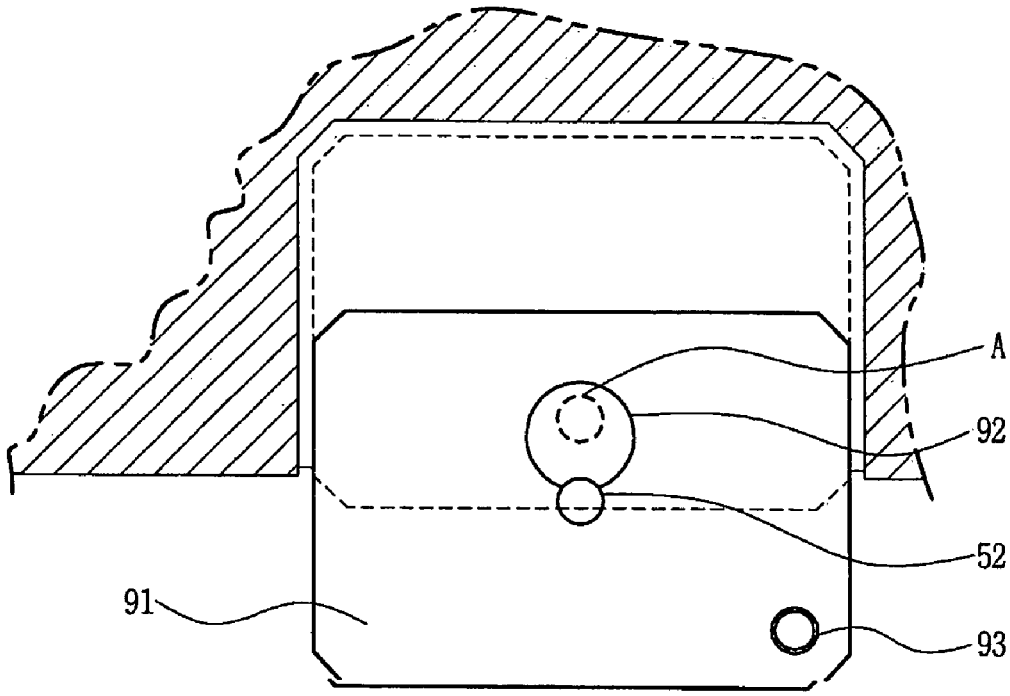
FIG. 15 is a top view illustrating an example of a dispenser with a housing including a water supply outlet in an extended position.

FIG. 15 is a top view illustrating an example of a dispenser with a housing including a water supply outlet in an extended position (e.g., the dispenser shown included in the refrigerator shown in FIG. 14). In implementations in which the outlet 52 is configured to extend to the front of (or outside of) the freezing chamber door 21, water may be supplied to a container having a larger width than the dispenser cavity 51. In these implementations, in order to supply water from the flow path 70 (refer to FIG. 10) to the outlet 52, a channel 92 may be formed at the rear side of the outlet 52 to include the original position A of the outlet 52. When the outlet 52 moves to the front, water may be supplied from the flow path 70 to the channel 92 and the channel 92 guides the water to the outlet 52. In one example, the flow path 70 and the outlet 52 may be connected by a pleated hose. The housing 91 may be configured to automatically or manually move. For example, the housing 91 may be configured to, responsive to user input, be automatically moved by a motor, a spring, or another type of mechanical drive mechanism. In some implementations, the housing 91 is configured to move the outlet 52 and the housing 54, the switch 55, the outlet 53, and the switch 56 remain stationary in response to movement of the housing 91. In other implementations, the housing 91 and the housing 54 may be attached (e.g., integrally formed with, attached via mechanical fastening or otherwise attached) with each other, so that the outlet 52, the housing 54, the switch 55, and the outlet 53 are configured to move together. In further implementations, the outlet 53 and the housing 54 may be disconnected, so that the outlet 52, the housing 54, and the switch 55 are configured to move together and the outlet 53 remains stationary. The housing 54 may be part of the housing 91 such that the switch 55 positioned on the housing 54 maintains its relative position to the outlet 52 when the housing 91 moves from the withdrawn position to the extended position. A button 93 may be provided on the upper surface of the housing 91. The button 93 may be configured to inspire dispensing of water through the outlet 52 responsive to actuation of the button 93. The button 93 may be configured such that it inspires dispensing of water through the outlet 52 responsive to actuation of the button 93 only when the housing 91 is in the extended position. For example, the button 93 may be configured such that the button 93 is hidden when the housing 91 is in the withdrawn or the control unit 91 may be configured to prevent dispensing of water through the outlet 52 in response to actuation of the button 93 when the housing 91 is in the extended position.

In some implementations, the switch 55 and the button 93 may be configured to inspire dispensing of water through the outlet 52 responsive to actuation of either the switch 55 or the button 93. In other implementations, only the button 93 is configured to inspire dispensing of water through the outlet 52 responsive to actuation of the button 93 when the housing 91 is in the extended position and only the switch 55 is configured to inspire dispensing of water through the outlet 52 responsive to actuation of the switch 55 when the housing 91 is in the withdrawn position. The switch 55 may be configured to inspire dispensing of water through the outlet 52 responsive to actuation of the switch 55 when the housing 91 is in the extended position only when the housing 54 and the switch 55 connected to the housing 91 and configured to move when the housing 91 moves from the withdrawn position to the extended position.

Figure 16:
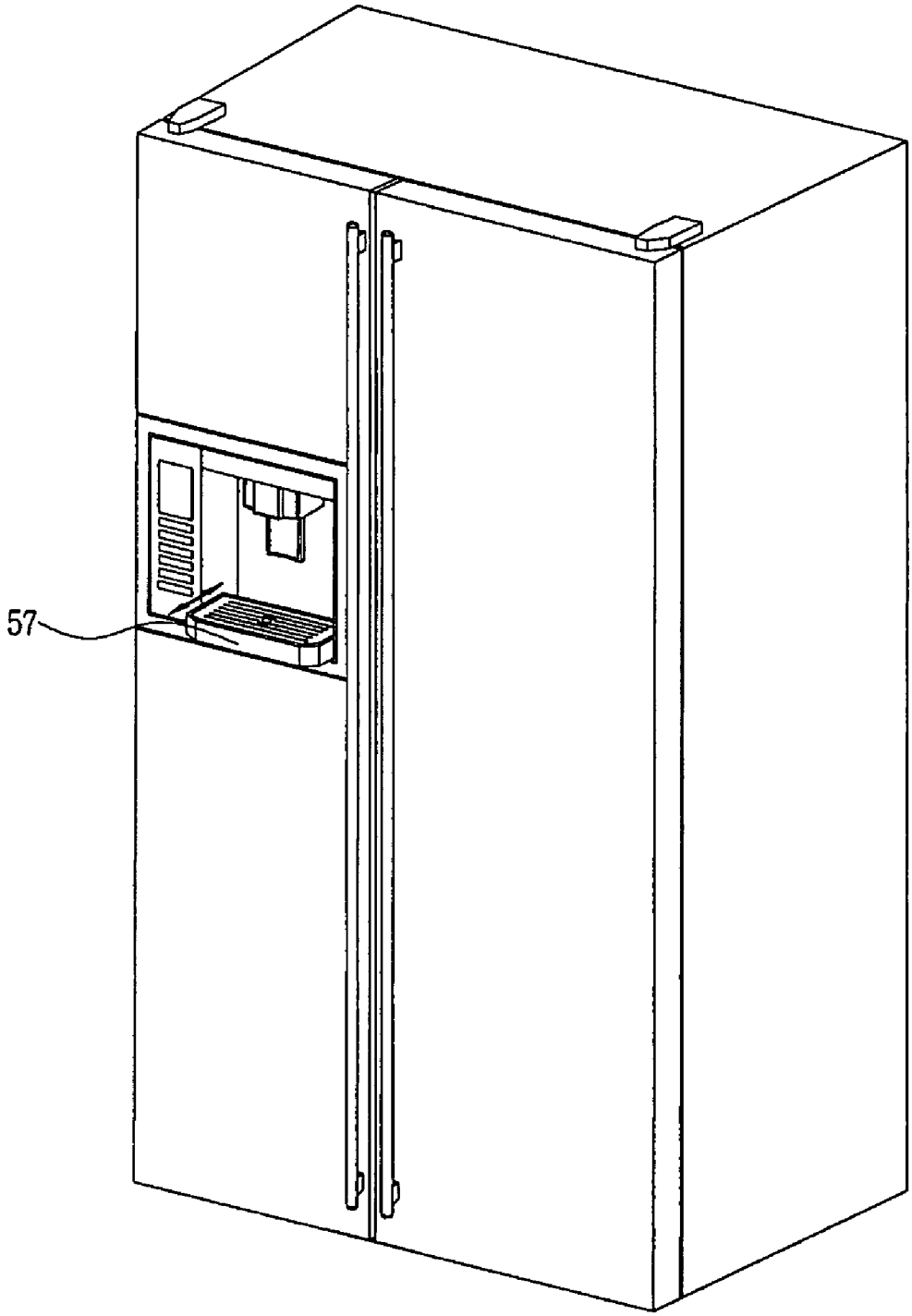
FIG. 16 is a perspective view illustrating an example of a refrigerator that includes a dispenser with a container support in an extended position.

FIG. 16 is a perspective view illustrating an example of a refrigerator that includes a dispenser with a container support in an extended position. In some implementations, the container support 57 may be slidably formed and configured to extend out to the front of (or outside of) the front of the freezing chamber door 21 (refer to FIG. 10). In these implementations, the space of the dispenser cavity 51 may be expanded and a larger container may be stably supported. In some examples, the outlet 52 may be positioned at the front portion of the dispenser cavity 51. In these examples, the outlet 52 may be configured to dispense water into a container that is too large to completely enter the dispenser cavity 51 and supported by the container support 57 in the extended position.

Figure 17:
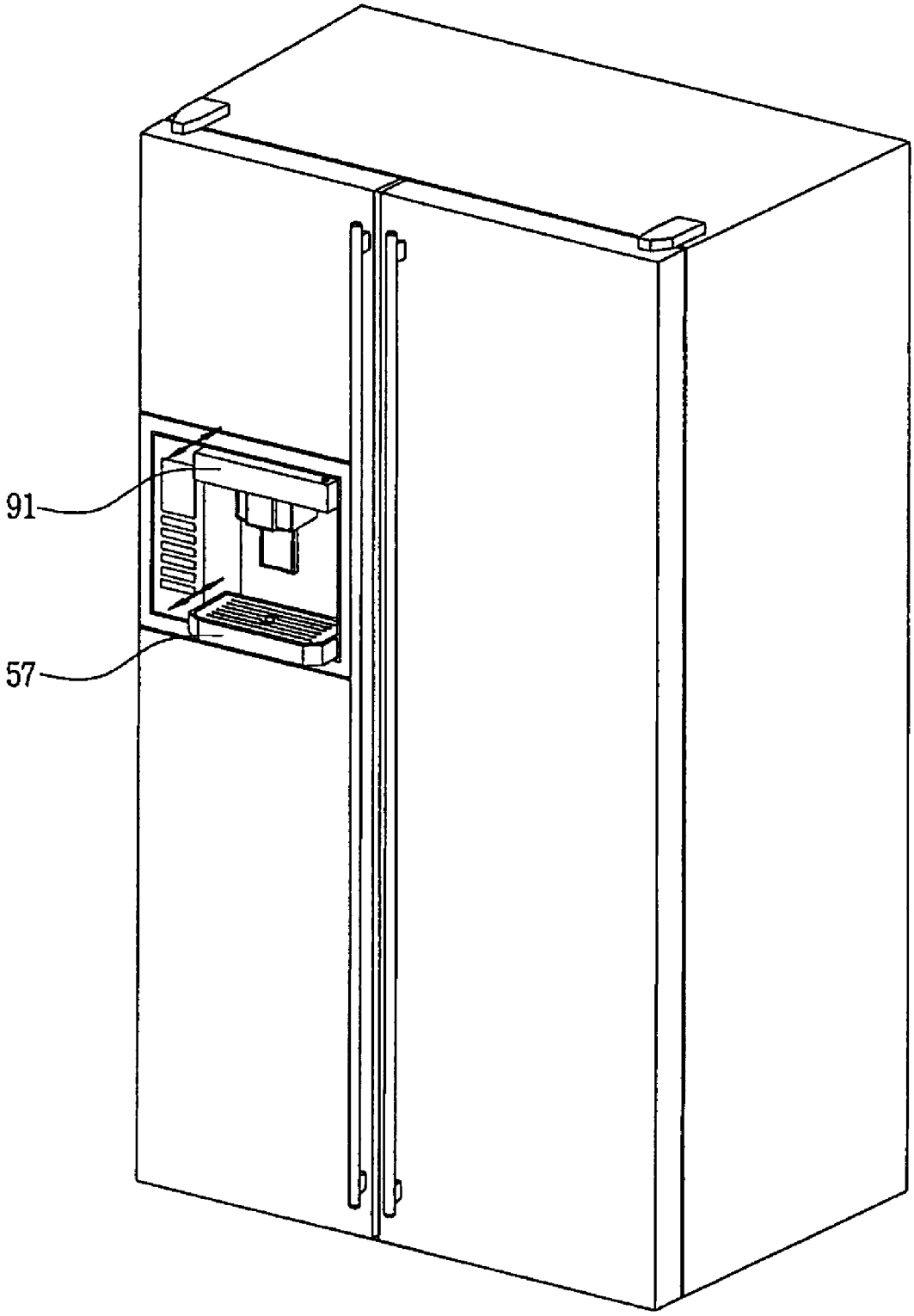
FIG. 17 is a perspective view illustrating an example of a refrigerator that includes a dispenser with a housing including a water supply outlet and a container support.

FIG. 17 is a perspective view illustrating an example of a refrigerator that includes a dispenser with a housing including a water supply outlet and a container support. The housing 91 for the outlet 52 and the support 57 may be slidably formed and configured to extend out to the front of (or outside of) the freezing chamber door 21 (refer to FIG. 10). In this example, the space of the dispenser cavity 51 may be expanded and a container may be placed on the support 57 and supplied with water by pressing the button 93 (refer to FIG. 14). In some implementations, the outlet 53 is movable. In these implementations, the button 93 and the button 66 may be connected in a manner such that pressing the button 93 may cause dispensing of ice through the outlet 53 when the outlet 53 is in an extended position.

Figure 18:
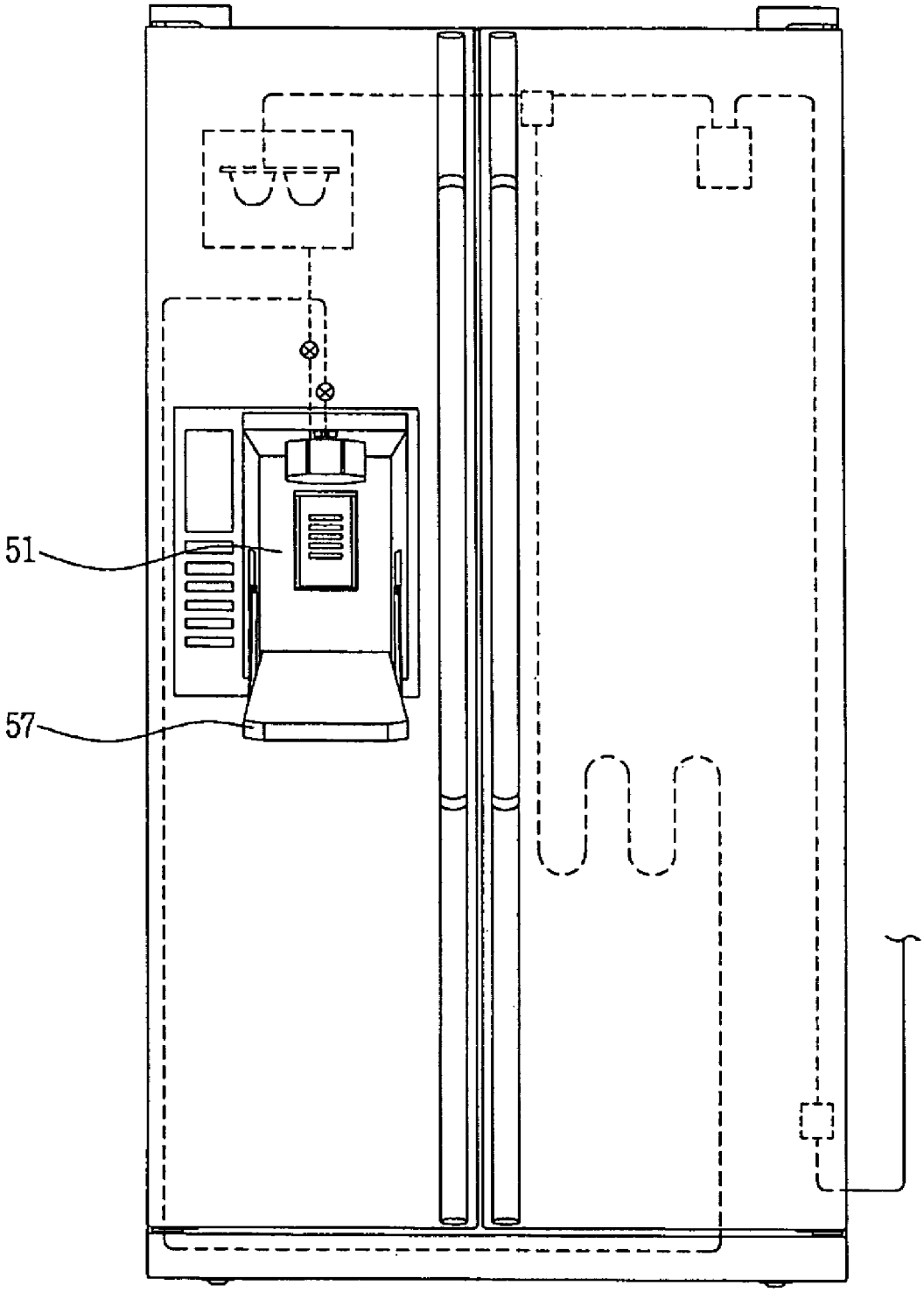
FIGS. 18-20 are front views illustrating examples of refrigerators that include dispensers.

FIG. 18 is a front view illustrating an example of a refrigerator that includes a dispenser. In some implementations, the support 57 may be configured to open and close the dispenser cavity 51. In these implementations, the depth of the dispenser cavity 51 may be reduced, the space of the dispenser cavity 51 may be expanded, the external appearance of the freezing chamber door may be improved, and children may be prevented from unnecessarily using the dispenser 50.

Figure 19:
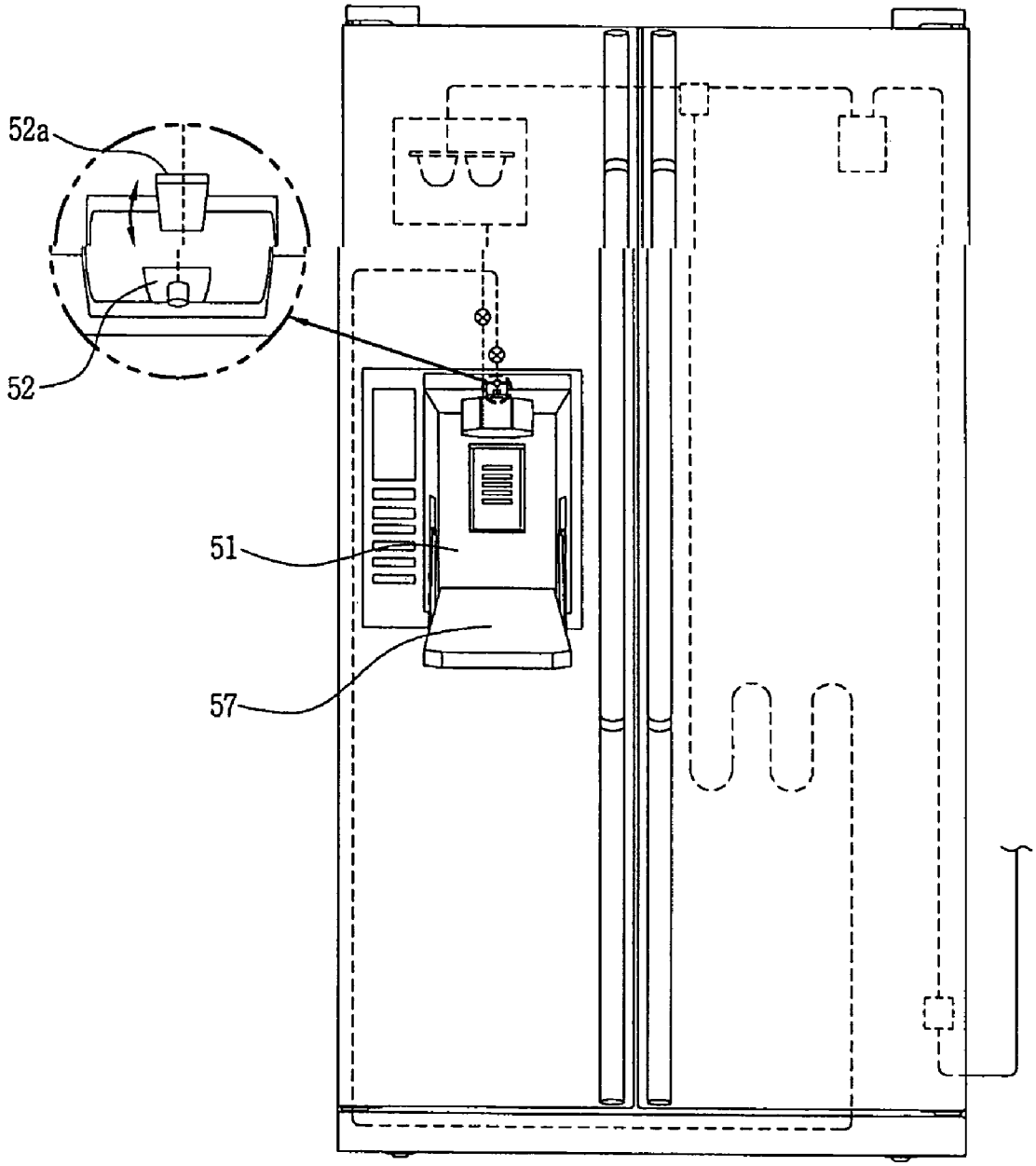

FIG. 19 is a front view illustrating an example of a refrigerator that includes a dispenser. A water discharge direction of the outlet 52 may be controlled by a handle 52*a*. When a container, which is too large to completely enter the dispenser cavity 51, is supported by a user's hand or placed on the container support 57 in the extended position, the container may be filled with water by using the handle 52*a* to turn the outlet 52 in a direction pointing out from the freezing chamber door 21.

Figure 20:
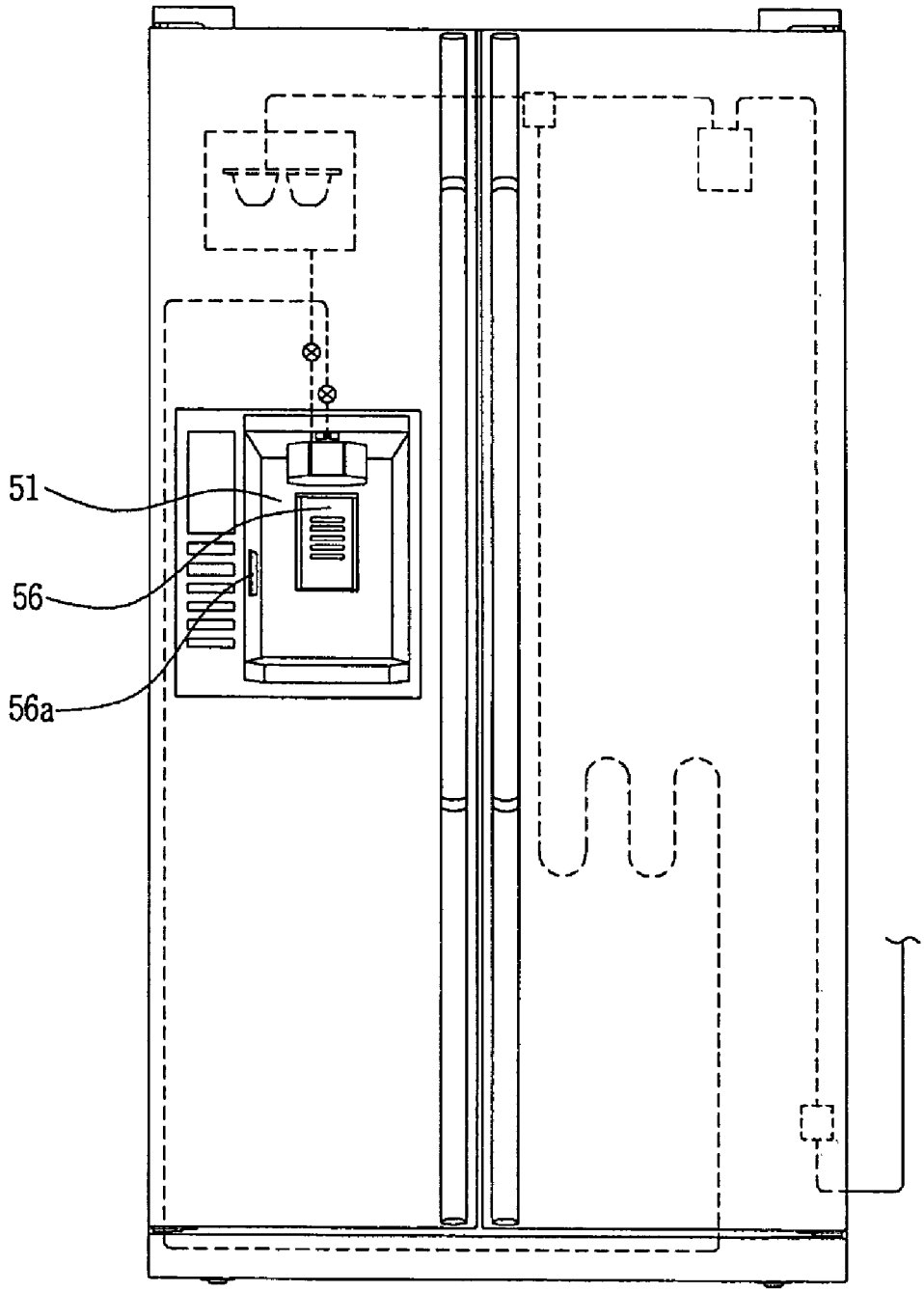

FIG. 20 is a front view illustrating an example of a refrigerator that includes a dispenser. A switch 56*a* may be provided at the side of the dispenser cavity 51. In implementations in which water and ice may be supplied through the outlet 53, the user may dispense ice by pressing the switch 56 with a cup using one hand and may dispense water by pressing the switch 56*a* using the other hand. It is also possible to omit the switch 56 and configured the switch 56*a* to control discharge ice. If the user presses the switch 56 by the user's hand or if the user places a cup on the support 57 and presses the switch 56, the ice discharged through the outlet 53 may touch the user hand. In implementations in which the switch 56 is omitted and the switch 56*a* is provided, the user may press switch 56*a* without the ice discharged through the outlet 53 touching the user's hand.

Figure 21:
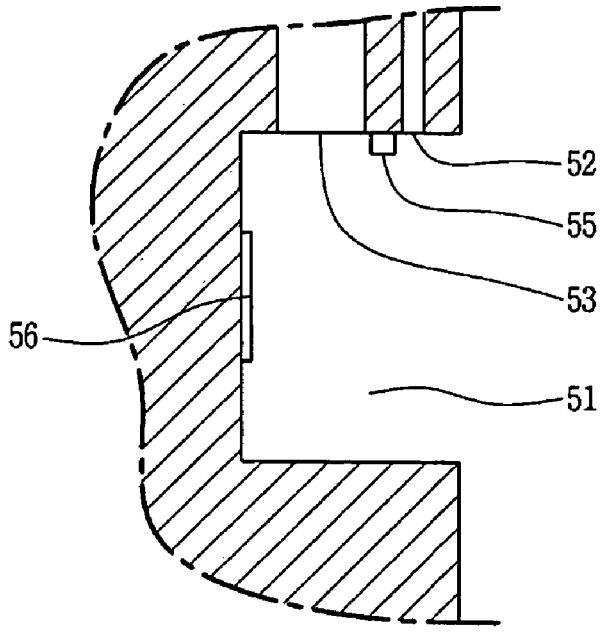
FIGS. 21 and 22 are side views illustrating examples of a dispenser structure.

FIG. 21 is a side view illustrating an example of a dispenser structure. In this example, the switch 55 is formed between the outlet 52 and the outlet 53 at a structure defining the upper surface of the dispenser cavity 51. The switch 56 is positioned on a back surface of the structure defining the dispenser cavity 51.

Figure 22:
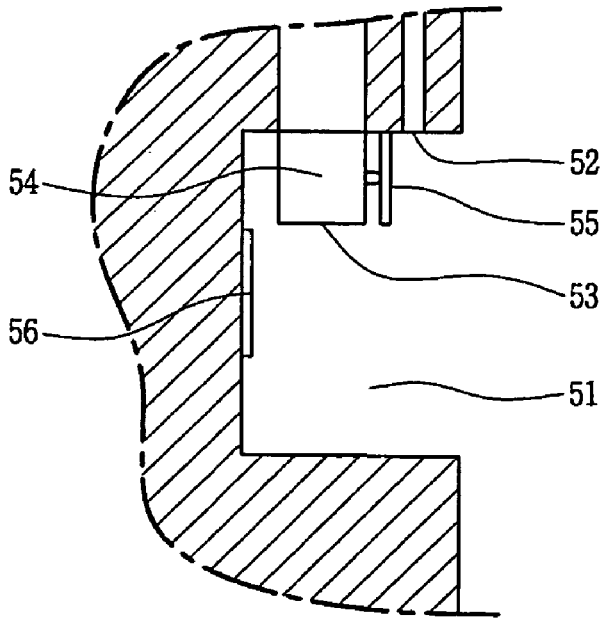

FIG. 22 is a side view illustrating an example of a dispenser structure. In this example, the switch 55 is a lever type switch and is provided between the outlet 52 and the outlet 53 on a front surface of the housing 54. The housing 54 may be configured to guide ice discharged through the outlet 53 and support the switch 55 used to control dispensing of liquid through the outlet 52. The switch 56 is positioned on a back surface of the structure defining the dispenser cavity 51.

What is claimed is:

1. A refrigerator dispenser, comprising:

a refrigerator dispensing assembly arranged integral to a refrigerator door and defining a cavity within a front surface of the refrigerator door;

an ice dispensing actuator positioned within the cavity defined by the refrigerator dispensing assembly;

an ice dispensing chute positioned within the cavity defined by the refrigerator dispensing assembly and oriented closer to the front surface of the refrigerator door than the ice dispensing actuator;

a liquid dispensing actuator positioned within the cavity defined by the refrigerator dispensing assembly and oriented closer to the front surface of the refrigerator door than the ice dispensing actuator and the ice dispensing chute; and a liquid dispensing chute oriented closer to the front surface of the refrigerator door than the ice dispensing actuator, the ice dispensing chute, and the liquid dispensing actuator, wherein the ice dispensing actuator, the ice dispensing chute, the liquid dispensing actuator, and the liquid dispensing chute are arranged in the following serial order, along a plane that extends substantially perpendicular to the front surface of the refrigerator door within which the cavity is defined, from a relatively deep position within the cavity to a relatively shallow position within the cavity or to the front of the cavity: the ice dispensing actuator, the ice dispensing chute, the liquid dispensing actuator, and the liquid dispensing chute.

2. The refrigerator dispenser of claim 1 wherein the liquid dispensing actuator is configured to accommodate being actuated by a deepest surface of a container inserted a relatively short distance into the cavity and wherein the ice dispensing actuator is configured to accommodate being actuated by the deepest surface of the container when inserted a further and relatively deep distance into the cavity, the relatively short distance being defined such that, upon actuation of the liquid dispensing actuator by the deepest surface of the container, the container is not positioned under the ice dispensing chute.

3. The refrigerator dispenser of claim 1 wherein the plane that extends substantially perpendicular to the front surface of the refrigerator door is a vertical plane.

4. The refrigerator dispenser of claim 1 wherein the liquid dispensing chute is positioned outside of the cavity defined by the refrigerator dispensing assembly.

5. The refrigerator dispenser of claim 1 wherein the liquid dispensing chute is positioned within the cavity defined by the refrigerator dispensing assembly, further comprising:

a liquid dispensing assembly to which the liquid dispensing chute is attached, the liquid dispensing assembly being configured to extend along a plane perpendicular to the front surface of the refrigerator door from a withdrawn position to an extended position to move the liquid dispensing chute outside of the refrigerator door cavity.

6. The refrigerator dispenser of claim 5 wherein the liquid dispensing actuator positioned in the ice dispensing cavity is a first liquid dispensing actuator, further comprising:

a second liquid dispensing actuator positioned on the liquid dispensing assembly, the second liquid dispensing actuator being configured to inspire dispensing of liquid through the liquid dispensing chute when the liquid dispensing assembly is in the extended position.

7. The refrigerator dispenser of claim 6 wherein the second liquid dispensing actuator is configured to inspire dispensing of liquid through the liquid dispensing chute only when the liquid dispensing assembly is in the extended position and the first liquid dispensing actuator is configured to inspire dispensing of liquid through the liquid dispensing chute only when the liquid dispensing assembly is in the withdrawn position.

8. The refrigerator dispenser of claim 6 wherein the second liquid dispensing actuator is positioned on a top surface of the liquid dispensing assembly and hidden when the liquid dispensing assembly is in the withdrawn position.

9. The refrigerator dispenser of claim 1 wherein the liquid dispensing actuator is positioned higher than the ice dispensing actuator.

10. The refrigerator dispenser of claim 1 wherein the liquid dispensing actuator is configured to accommodate being actuated by a deepest surface of a container such that a container whose deepest surface actuates the liquid dispensing actuator is not positioned below the ice dispensing chute and thus is not exposed to ice dispensed through the ice dispensing chute.

11. The refrigerator dispenser of claim 10 wherein the liquid dispensing actuator is configured to accommodate being actuated by the deepest surface of the container such that an opening of the container is positioned in front of an outlet of the ice dispensing chute.

12. The refrigerator dispenser of claim 10 wherein the liquid dispensing actuator is configured to accommodate being actuated by the deepest surface of the container such that an opening of the container is positioned above an outlet of the ice dispensing chute.

13. The refrigerator dispenser of claim 1 wherein the refrigerator door is a door of a refrigerating compartment of a refrigerator or a door of a freezing compartment of a refrigerator.

14. A refrigerator comprising:

a refrigerator door; and a dispenser arranged integral to the refrigerator door, the dispenser including:

a housing defining a cavity within a front surface of the refrigerator door;

an ice dispensing actuator positioned within the cavity defined by the housing;

an ice dispensing chute positioned within the cavity defined by the housing and oriented closer to the front surface of the refrigerator door than the ice dispensing actuator;

a liquid dispensing actuator positioned within the cavity defined by the housing and oriented closer to the front surface of the refrigerator door than the ice dispensing actuator and the ice dispensing chute; and a liquid dispensing chute oriented closer to the front surface of the refrigerator door than the ice dispensing actuator, the ice dispensing chute, and the liquid dispensing actuator, wherein the ice dispensing actuator, the ice dispensing chute, the liquid dispensing actuator, and the liquid dispensing chute are arranged in the following serial order, along a plane that extends substantially perpendicular to the front surface of the refrigerator door within which the cavity is defined, from a relatively deep position within the cavity to a relatively shallow position within the cavity or to the front of the cavity: the ice dispensing actuator, the ice dispensing chute, the liquid dispensing actuator, and the liquid dispensing chute.

15. The refrigerator of claim 14 wherein the liquid dispensing actuator is configured to accommodate being actuated by a deepest surface of a container inserted a relatively short distance into the cavity and wherein the ice dispensing actuator is configured to accommodate being actuated by the deepest surface of the container when inserted a further and relatively deep distance into the cavity, the relatively short distance being defined such that, upon actuation of the liquid dispensing actuator by the deepest surface of the container, the container is not positioned under the ice dispensing chute.

16. The refrigerator of claim 14 wherein the liquid dispensing actuator is configured to accommodate being actuated by a deepest surface of a container such that a container whose deepest surface actuates the liquid dispensing actuator is not positioned below the ice dispensing chute and thus is not exposed to ice dispensed through the ice dispensing chute.

17. The refrigerator of claim 14 wherein the liquid dispensing chute is positioned within the cavity defined by the refrigerator dispensing assembly, further comprising:

a liquid dispensing assembly to which the liquid dispensing chute is attached, the liquid dispensing assembly being configured to extend along a plane perpendicular to the front surface of the refrigerator door from a withdrawn position to an extended position to move the liquid dispensing chute outside of the cavity.

18. The refrigerator of claim 17 wherein the liquid dispensing actuator positioned in the ice dispensing cavity is a first liquid dispensing actuator, further comprising:

a second liquid dispensing actuator positioned on the liquid dispensing assembly, the second liquid dispensing actuator being configured to inspire dispensing of liquid through the liquid dispensing chute when the liquid dispensing assembly is in the extended position.

19. The refrigerator dispenser of claim 18 wherein the second liquid dispensing actuator is configured to inspire dispensing of liquid through the liquid dispensing chute only when the liquid dispensing assembly is in the extended position and the first liquid dispensing actuator is configured to inspire dispensing of liquid through the liquid dispensing chute only when the liquid dispensing assembly is in the withdrawn position.

20. A method of dispensing ice and liquid using a dispenser, the method comprising:

receiving actuation of an ice dispensing actuator positioned on a back surface of a dispenser housing that defines a dispensing cavity, the ice dispensing actuator being actuated by a deepest surface of a container such that, upon actuation, the container is positioned under an ice dispensing chute;

dispensing ice into the container through the ice dispensing chute in response to receiving actuation of the ice dispensing actuator;

receiving actuation of a liquid dispensing actuator positioned within the cavity defined by the dispenser housing and oriented closer to a front surface of a refrigerator door than the ice dispensing actuator and the ice dispensing chute, the liquid dispensing actuator being actuated by the deepest surface of the container such that, upon actuation, the container is positioned under a liquid dispensing chute and not positioned under the ice dispensing chute; and dispensing liquid into the container through the liquid dispensing chute in response to receiving actuation of the liquid dispensing actuator.

* * * * *